US010950945B2

(12) United States Patent
Onaka et al.

(10) Patent No.: US 10,950,945 B2
(45) Date of Patent: Mar. 16, 2021

(54) ANTENNA ELEMENT, ANTENNA MODULE, AND COMMUNICATION APPARATUS

(71) Applicant: Murata Manufacturing Co., Ltd., Kyoto (JP)

(72) Inventors: Kengo Onaka, Kyoto (JP); Yoshiki Yamada, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 10 days.

(21) Appl. No.: 16/372,941

(22) Filed: Apr. 2, 2019

(65) Prior Publication Data

US 2019/0229421 A1 Jul. 25, 2019

Related U.S. Application Data

(63) Continuation of application No. PCT/JP2017/037252, filed on Oct. 13, 2017.

(30) Foreign Application Priority Data

Oct. 19, 2016 (JP) ..... JP2016-205559

(51) Int. Cl.
*H01Q 9/04* (2006.01)
*H01Q 1/38* (2006.01)
(Continued)

(52) U.S. Cl.
CPC ..... *H01Q 9/045* (2013.01); *H01Q 1/38* (2013.01); *H01Q 3/26* (2013.01); *H01Q 3/36* (2013.01);
(Continued)

(58) Field of Classification Search
CPC ..... H01Q 9/045; H01Q 9/0407; H01Q 23/00; H01Q 9/0485; H01Q 1/38; H01Q 5/378; H01Q 13/10; H01Q 21/30; H01Q 7/00
See application file for complete search history.

(56) References Cited

U.S. PATENT DOCUMENTS 6,184,828 B1 * 2/2001 Shoki ..... H01Q 3/26 342/372
2005/0179596 A1 8/2005 Higasa et al.
(Continued)

FOREIGN PATENT DOCUMENTS

GB 2559001 A * 7/2018 ..... H01Q 1/526
JP H06-326510 A 11/1994
(Continued)

OTHER PUBLICATIONS

International Search Report for International Application No. PCT/JP2017/037252 dated Dec. 19, 2017.
Written Opinion for International Application No. PCT/JP2017/037252 dated Dec. 19, 2017.

*Primary Examiner* — Ricardo I Magallanes
(74) *Attorney, Agent, or Firm* — Pearne & Gordon LLP

(57) ABSTRACT

A patch antenna (10) includes a planar first power feeding conductor pattern (11) that is formed on a dielectric substrate (20) and to which a radio frequency signal is fed, a planar second power feeding conductor pattern (12) that is formed on the dielectric substrate (20) and is arranged to be isolated from the first power feeding conductor pattern (11) so as to interpose the first power feeding conductor pattern (11) in the polarization direction when the dielectric substrate (20) is seen in a plan view, and a planar ground conductor pattern (13) that is formed on the dielectric substrate (20) so as to face the first power feeding conductor pattern (11) and the second power feeding conductor pattern (12) and is set to have a ground potential, wherein the second power feeding conductor pattern (12) is not set to have the ground potential.

11 Claims, 13 Drawing Sheets

(51) Int. Cl.

| | |
|---|---|
| ***H01Q 3/36*** | (2006.01) |
| ***H01Q 21/06*** | (2006.01) |
| ***H01Q 9/06*** | (2006.01) |
| ***H01Q 3/26*** | (2006.01) |
| ***H01Q 13/08*** | (2006.01) |
| ***H01Q 5/378*** | (2015.01) |
| ***H01Q 21/28*** | (2006.01) |
| ***H01Q 5/321*** | (2015.01) |
| ***H01Q 23/00*** | (2006.01) |

(52) U.S. Cl.

CPC ..... *H01Q 5/321* (2015.01); *H01Q 5/378* (2015.01); *H01Q 9/04* (2013.01); *H01Q 9/0485* (2013.01); *H01Q 9/06* (2013.01); *H01Q 13/08* (2013.01); *H01Q 21/06* (2013.01); *H01Q 21/065* (2013.01); *H01Q 21/28* (2013.01); *H01Q 23/00* (2013.01)

(56) References Cited

U.S. PATENT DOCUMENTS

| | | | | |
|---|---|---|---|---|
| 2014/0203993 | A1* | 7/2014 | Toyao ..... | H01P 5/107 343/867 |
| 2015/0311588 | A1* | 10/2015 | Wong ..... | H01Q 7/00 342/374 |
| 2017/0222312 | A1 | 8/2017 | Sudo et al. | |
| 2018/0287268 | A1 | 10/2018 | Kosaka et al. | |

FOREIGN PATENT DOCUMENTS

| | | | | |
|---|---|---|---|---|
| JP | 2005-236393 | A | 9/2005 | |
| JP | 2008-177888 | A | 7/2008 | |
| JP | 2016-025592 | A | 2/2016 | |
| WO | WO-2015159505 | A1 * | 10/2015 | ..... H01Q 13/08 |
| WO | 2016/059961 | A1 | 4/2016 | |
| WO | 2016/132712 | A1 | 8/2016 | |

* cited by examiner

| | HOR. | VER. |
|---|---|---|
| MAX | 6.5 | -19.1 |
| AVE | 0.9 | -24.5 |

| | HOR. | VER. |
|---|---|---|
| MAX | 6.6 | -27.7 |
| AVE | 0.9 | -32.4 |

| | HOR. | VER. |
|---|---|---|
| MAX | 6.8 | -89.1 |
| AVE | 1.3 | -96.1 |

| | HOR. | VER. |
|---|---|---|
| MAX | 6.5 | -47.3 |
| AVE | 0.7 | -52.0 |

| | HOR. | VER. |
|---|---|---|
| MAX | 4.9 | -61.3 |
| AVE | -0.6 | -66.2 |

| | HOR. | VER. |
|---|---|---|
| MAX | 5.2 | -48.4 |
| AVE | -0.2 | -52.5 |

ANTENNA ELEMENT, ANTENNA MODULE, AND COMMUNICATION APPARATUS

This is a continuation of International Application No. PCT/JP2017/037252 filed on Oct. 13, 2017 which claims priority from Japanese Patent Application No. 2016-205559 filed on Oct. 19, 2016. The contents of these applications are incorporated herein by reference in their entireties.

BACKGROUND OF THE DISCLOSURE

Field of the Disclosure

The present disclosure relates to an antenna element, an antenna module, and a communication apparatus.

Description of the Related Art

Multi-band wireless communication antennas include, for example, different-frequency sharing antennas disclosed in Patent Document 1 is cited. A two-frequency sharing antenna disclosed in Patent Document 1 has a first radiation conductor formed on an upper surface of a dielectric substrate, an annular second radiation conductor formed so as to surround the first radiation conductor, and a grounding conductor formed on a lower surface of the dielectric substrate. A power feeding pin is connected to the first radiation conductor, and a radio frequency signal is fed to the first radiation conductor with the power feeding pin interposed therebetween. Further, a plurality of short pins are connected to the second radiation conductor, and the second radiation conductor is connected to the grounding conductor with the plurality of short pins interposed therebetween. An interval allowing the electromagnetic coupling between the first radiation conductor and the second radiation conductor is provided therebetween. With the above configuration, the two-frequency sharing antenna excites the first radiation conductor at a frequency fH by power feeding from the power feeding pin, and the second radiation conductor and the first radiation conductor are excited at a frequency fL lower than the frequency fH by the electromagnetic coupling therebetween.

Patent Document 1: Japanese Unexamined Patent Application Publication No. 2005-236393

BRIEF SUMMARY OF THE DISCLOSURE

However, in the two-frequency sharing antenna described in Patent Document 1, since the second radiation conductor is connected to the grounding conductor with the plurality of short pins interposed therebetween, a radio frequency current flowing through the second radiation conductor also flows to the short pins and the grounding conductor. Therefore, an electric length and a current direction of the second radiation conductor are not fixed, and a radiation direction is directed also toward a lower elevation angle direction and a downward direction, resulting in a problem that directivity in a zenith direction (vertical line upward direction of the dielectric substrate) is weakened.

Therefore, it is an object of the present disclosure to provide an antenna element, an antenna module, and a communication apparatus capable of exciting radio frequency signals of a plurality of frequency bands and having directivity in a zenith direction (vertical line upward direction) from an antenna plane in all of the plurality of frequency bands.

In order to achieve the above object, an antenna element according to an aspect of the present disclosure includes a dielectric substrate, a planar first power feeding conductor pattern that is formed on the dielectric substrate and to which a radio frequency signal is fed, a planar second power feeding conductor pattern that is formed on the dielectric substrate and is arranged to be isolated from the first power feeding conductor pattern so as to interpose the first power feeding conductor pattern in a polarization direction when the dielectric substrate is seen in a plan view, and a planar ground conductor pattern that is formed on the dielectric substrate so as to face the first power feeding conductor pattern and the second power feeding conductor pattern and is set to have a ground potential, wherein the second power feeding conductor pattern is not set to have the ground potential.

With this configuration, radiation characteristics of a radio frequency signal having a first resonant frequency defined by the first power feeding conductor pattern have directivity in the zenith direction of the first power feeding conductor pattern (vertical line direction on the opposite side to the ground conductor pattern with respect to the first power feeding conductor pattern) with fundamental waves of the radio frequency signal. Moreover, radiation characteristics of a radio frequency signal having a second resonant frequency defined by the first power feeding conductor pattern and the second power feeding conductor pattern, which are electromagnetically coupled to each other, have directivity in the zenith direction of the first power feeding conductor pattern and the second power feeding conductor pattern with fundamental waves of the radio frequency signal because the second power feeding conductor pattern is not grounded. That is to say, it is possible to excite the radio frequency signals of a plurality of frequency bands and to ensure the directivity in the above zenith direction from the antenna plane in all of the plurality of frequency bands. Further, since all radiation is caused by an action with the fundamental waves, the radiation characteristics with a wide bandwidth can be provided.

The second power feeding conductor pattern may be an annular conductor pattern arranged with a predetermined interval from the first power feeding conductor pattern so as to surround the first power feeding conductor pattern in the plan view.

With this configuration, since the second power feeding conductor pattern is one continuous conductor pattern, the radiation intensity of the radio frequency signal having the second resonant frequency is further increased, and the directivity in the above zenith direction becomes higher.

Further, the antenna element may further include an impedance element that connects the first power feeding conductor pattern to the second power feeding conductor pattern, a first resonant frequency defined by the first power feeding conductor pattern may be higher than a second resonant frequency defined by the first power feeding conductor pattern and the second power feeding conductor pattern, and an impedance of the impedance element at the second resonant frequency may be lower than an impedance of the impedance element at the first resonant frequency.

With this configuration, when the radio frequency signal having the first resonant frequency is excited, the impedance of the impedance element becomes high, so that the second power feeding conductor pattern does not function as the conductor pattern. Therefore, the radiation characteristics of the radio frequency signal having the first resonant frequency have the directivity in the above zenith direction of the first power feeding conductor pattern with the fundamental waves of the radio frequency signal. In addition, when the radio frequency signal having the second resonant frequency is excited, the impedance of the impedance element becomes low, so that the first power feeding conductor pattern and the second power feeding conductor pattern tend to function as an integral conductor pattern. Therefore, the radiation characteristics of the radio frequency signal having the second resonant frequency can have higher directivity in the above zenith direction of the first power feeding conductor pattern and the second power feeding conductor pattern with the fundamental waves of the radio frequency signal. That is to say, it is possible to excite the radio frequency signals of the plurality of frequency bands and to ensure the high directivity in the above zenith direction from the antenna plane in all of the plurality of frequency bands. Further, since all radiation is caused by the action with the fundamental waves, the radiation characteristics with a wide bandwidth can be provided.

The impedance element may be constituted by an LC resonance circuit.

With this configuration, the impedance element can be formed by using a conductor pattern and a dielectric substrate, so that it is possible to reduce the size.

The antenna element may include the plurality of impedance elements, and the plurality of impedance elements may be arranged at positions between the first power feeding conductor pattern and the second power feeding conductor pattern so as to be symmetrical with respect to the first power feeding conductor pattern in the plan view.

With this configuration, since resonance balance of the radio frequency signal is improved, it is possible to further enhance the directivity in the zenith direction while increasing antenna gain.

The antenna element may further include a notch antenna that is formed on a surface of the dielectric substrate or inside the dielectric substrate on an outer peripheral portion of the second power feeding conductor pattern in the plan view, and the notch antenna may include a planar second ground conductor pattern formed on the surface, a ground non-formation region interposed between portions of the second ground conductor pattern, a radiation electrode formed on the surface in the ground non-formation region, and a capacitive element arranged in the ground non-formation region and connected to the radiation electrode.

With this configuration, since the antenna element includes the patch antenna and the notch antenna, they can support different frequency bands, so that a multi-band antenna can be easily designed. Further, since the patch antenna and the notch antenna have different directivities, it is possible to simultaneously have directivity in a plurality of directions.

The antenna element may include the plurality of antenna elements that are arrayed in a one-dimensional or two-dimensional manner, and the plurality of antenna elements may share the dielectric substrate and share the ground conductor pattern.

With this configuration, it is possible to form the antenna element in which the plurality of antenna elements are arranged in the one-dimensional or two-dimensional manner on the same dielectric substrate. Thus, it is possible to realize a phased array antenna which has basic radiation characteristics having the high directivity in the above zenith direction of the substrate and can control the directivity with an adjusted phase for each antenna element.

An antenna module according to still another aspect of the disclosure includes the above-described antenna element, and a power feeding circuit that feeds the radio frequency signal to the first power feeding conductor pattern, wherein the first power feeding conductor pattern and the second power feeding conductor pattern are formed on a first main surface of the dielectric substrate, the ground conductor pattern is formed on a second main surface of the dielectric substrate, which opposes the first main surface, and the power feeding circuit is formed on the second main surface side of the dielectric substrate.

With this configuration, it is possible to realize a small-sized antenna module having directivity to the first main surface side in the vertical line direction of the dielectric substrate.

A communication apparatus according to still another aspect of the disclosure includes the above-described antenna element, and an RF signal processing circuit that feeds the radio frequency signal to the firsts power feeding conductor pattern, wherein the RF signal processing circuit includes a phase shift circuit shifting a phase of the radio frequency signal, an amplifying circuit amplifying the radio frequency signal the phase of which has been shifted; and a switch element switching feeding and non-feeding of the amplified high-frequency to the antenna element.

With this configuration, it is possible to realize a multi-band/multi-mode communication apparatus capable of controlling directivity of antenna gain characteristics and providing radiation characteristics with a widened bandwidth.

A communication apparatus according to still another aspect of the disclosure includes a first array antenna and a second array antenna, an RF signal processing circuit that feeds a radio frequency signal to a first power feeding conductor pattern, and a housing in which the first array antenna, the second array antenna, and the RF signal processing circuit are arranged, wherein the housing is a hexahedron having a first outer peripheral surface as a main surface, a second outer peripheral surface opposing the first outer peripheral surface, a third outer peripheral surface perpendicular to the first outer peripheral surface, a fourth outer peripheral surface opposing the third outer peripheral surface, a fifth outer peripheral surface perpendicular to the first outer peripheral surface and the third outer peripheral surface, and a sixth outer peripheral surface opposing the fifth outer peripheral surface, the first array antenna includes a first antenna element as the above-described antenna element, which is arranged such that a direction from the ground conductor pattern toward the first power feeding conductor pattern coincides with a first direction from the second outer peripheral surface toward the first outer peripheral surface and a direction from the first power feeding conductor pattern toward the notch antenna coincides with a second direction from the fourth outer peripheral surface toward the third outer peripheral surface, and a second antenna element as the above-described antenna element, which is arranged such that the direction from the ground conductor pattern toward the first power feeding conductor pattern coincides with the first direction and the direction from the first power feeding conductor pattern toward the notch antenna coincides with a third direction from the sixth outer peripheral surface toward the fifth outer peripheral surface, and the second array antenna includes a third antenna element as the above-described antenna element, which is arranged such that the direction from the ground conductor pattern toward the first power feeding conductor pattern coincides with a fourth direction from the first outer peripheral surface toward the second outer peripheral surface and the direction from the first power feeding conductor pattern toward the notch antenna coincides with a fifth direction from the third outer peripheral surface toward the fourth outer peripheral surface, and a fourth antenna element as the above-described antenna element, which is arranged such that the direction from the ground conductor pattern toward the first power feeding conductor pattern coincides with the fourth direction and the direction from the first power feeding conductor pattern toward the notch antenna coincides with a sixth direction from the fifth outer peripheral surface toward the sixth outer peripheral surface.

With this configuration, the first array antenna has directivity in the first direction, the second direction, and the third direction of the communication apparatus. Further, the second array antenna has directivity in the fourth direction, the fifth direction, and the sixth direction of the communication apparatus. Thus, it is possible to provide directivity in all directions of the communication apparatus.

According to the present disclosure, it is possible to provide an antenna element, an antenna module, and a communication apparatus capable of exciting radio frequency signals of a plurality of frequency bands and having directivity in a zenith direction (vertical upward direction) from an antenna plane in all of the plurality of frequency bands.

DETAILED DESCRIPTION OF THE DISCLOSURE

Figure 1:
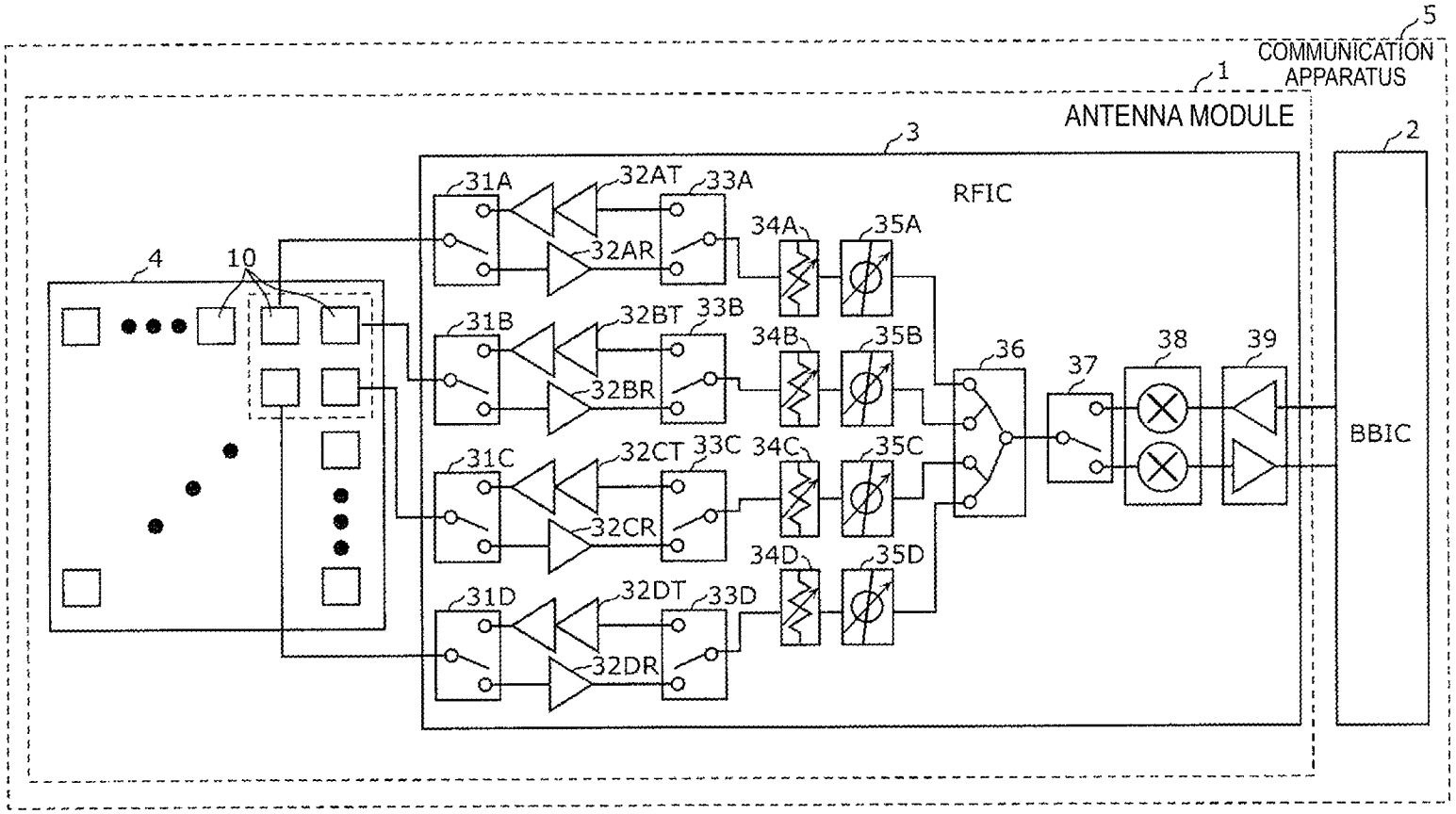
FIG. 1 is a circuit diagram of a communication apparatus according to a first embodiment.

Hereinafter, embodiments of the present disclosure will be described in detail with reference to the accompanying drawings. It should be noted that each of the embodiments described below represents a comprehensive or specific example. Numerical values, shapes, materials, components, arrangement and connection forms of the components, and the like described in the following embodiments are merely examples and are not intended to limit the disclosure. Components of the following embodiments that are not described in the independent claims will be described as optional components. Further, sizes or size ratios of the components illustrated in the drawings are not necessarily critical.

First Embodiment

[1.1 Circuit Configuration of Communication Apparatus]

FIG. 1 is a circuit diagram of a communication apparatus 5 according to a first embodiment. The communication apparatus 5 illustrated in FIG. 1 includes an antenna module 1 and a baseband signal processing circuit (BBIC) 2. The antenna module 1 includes an array antenna 4 and an RF signal processing circuit (RFIC) 3. The communication apparatus 5 up-converts a signal transmitted from the baseband signal processing circuit (BBIC) 2 to the antenna module 1 into a radio frequency signal and radiates the signal from the array antenna 4 whereas it down-converts a radio frequency signal received by the array antenna 4 and performs signal processing on the signal in the baseband signal processing circuit (BBIC) 2.

The array antenna 4 has a plurality of patch antennas 10 arrayed in a two-dimensional manner. Each patch antenna 10 is an antenna element that operates as a radiating element radiating radio waves (high frequency signals) and a reception element receiving radio waves (high frequency signals), and has main characteristics of the disclosure. In this embodiment, the array antenna 4 can constitute a phased array antenna.

The patch antenna 10 can excite the radio frequency signals of two frequency bands, and has high directivity in the zenith direction (the vertical line upward direction of an antenna plane) from the antenna plane in all of the plurality of frequency bands. Details of the main characteristics of the patch antenna 10 will be described later.

The RF signal processing circuit (RFIC) 3 includes switches 31A to 31D, 33A to 33D, 37, power amplifiers 32AT to 32DT, low noise amplifiers 32AR to 32DR, attenuators 34A to 34D, phase shifters 35A to 35D, a signal multiplexer/demultiplexer 36, a mixer 38, and an amplifier circuit 39.

The switches 31A to 31D and 33A to 33D are switching circuits for switching transmission and reception in signal paths.

The signal transmitted from the baseband signal processing circuit (BBIC) 2 is amplified by the amplifier circuit 39 and up-converted by the mixer 38. The up-converted radio frequency signal is demultiplexed into four signals by the signal multiplexer/demultiplexer 36, and the demultiplexed signals pass through four transmission paths to be fed to different patch antennas 10. At this time, it is possible to adjust the directivity of the array antenna 4 by individually adjusting phase shift degrees of the phase shifters 35A to 35D arranged in the respective signal paths.

Further, the radio frequency signals received by the patch antennas 10 of the array antenna 4 pass through four different reception paths and are multiplexed by the signal multiplexer/demultiplexer 36. The multiplexed signal is down-converted by the mixer 38, is amplified by the amplifier circuit 39, and is transmitted to the baseband signal processing circuit (BBIC) 2.

The RF signal processing circuit (RFIC) 3 is formed as a one-chip integrated circuit component including, for example, the circuit configuration described above.

Note that the RF signal processing circuit (RFIC) 3 may not include any of the switches 31A to 31D, 33A to 33D, 37, the power amplifiers 32AT to 32DT, the low noise amplifiers 32AR to 32DR, the attenuators 34A to 34D, the phase shifters 35A to 35D, the signal multiplexer/demultiplexer 36, the mixer 38, and the amplifier circuit 39. Further, the RF signal processing circuit (RFIC) 3 may have only one of the transmission path and the reception path. The antenna module 1 according to the embodiment is applied to a system that not only transmits and receives radio frequency signals of a single frequency band (band), but also transmits and receives radio frequency signals of a plurality of frequency bands (multi-band). Accordingly, in practice, the antenna module 1 according to the embodiment is configured such that equal to or more than two systems of the circuit configurations of the RF signal processing circuit (RFIC) 3 in FIG. 1 are arranged, and the circuit configurations are switched by a switch.

[1.2 Configuration of Patch Antenna]

Figure 2:
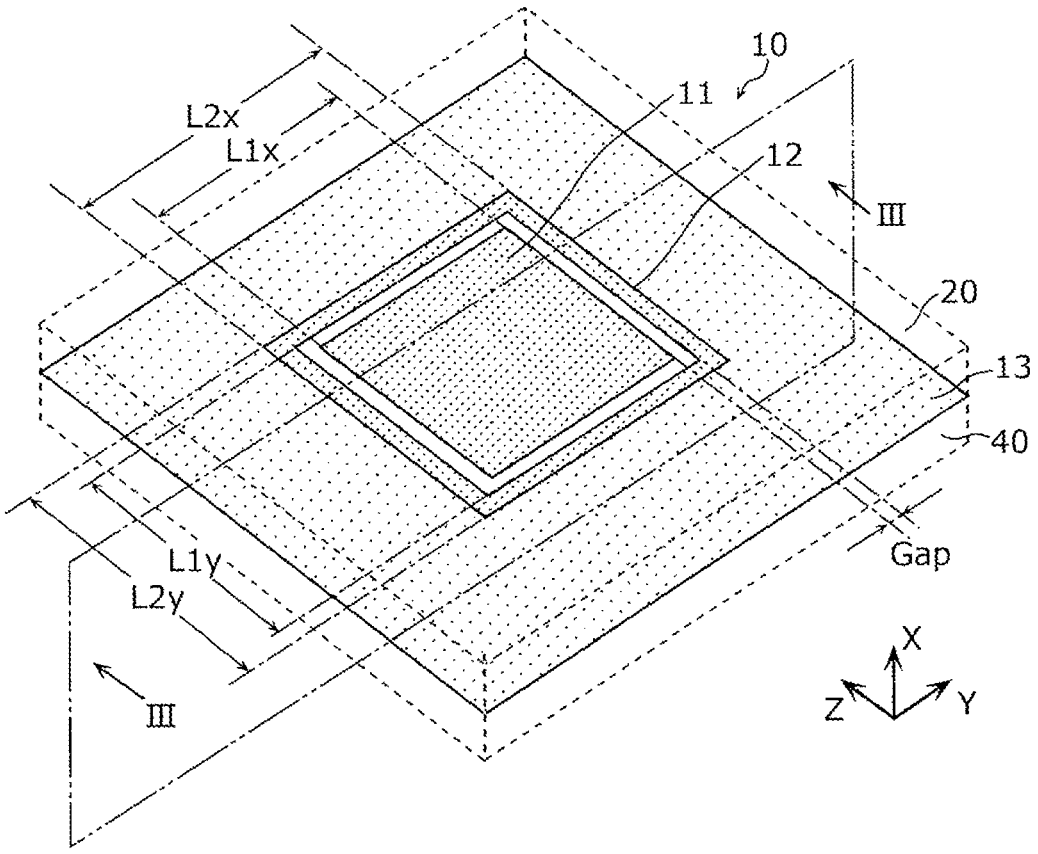
FIG. 2 is a perspective view illustrating an outer appearance of a patch antenna according to the first embodiment.
Figure 3:
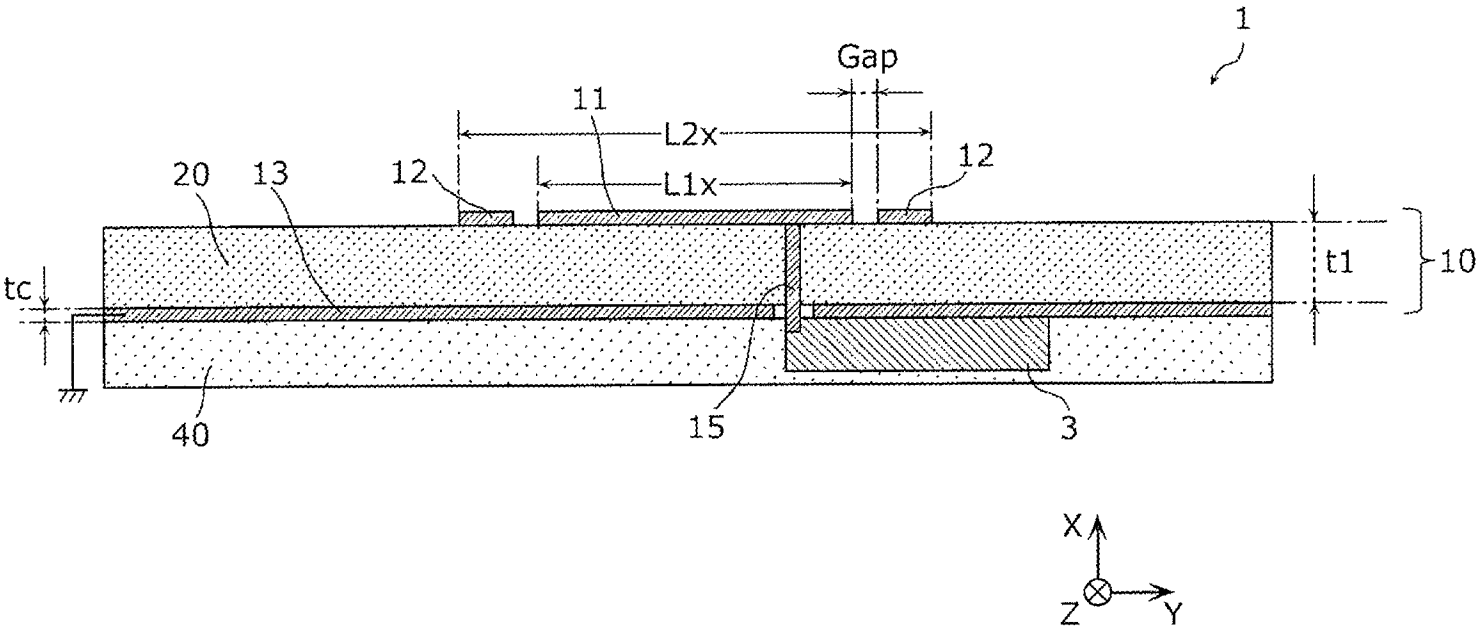
FIG. 3 is a cross-sectional view of an antenna module according to the first embodiment.

FIG. 2 is a perspective view illustrating an outer appearance of the patch antenna 10 according to the first embodiment. FIG. 3 is a cross-sectional view of the antenna module 1 according to the first embodiment. FIG. 3 is a cross-sectional view taken along a line III-III of FIG. 2. FIG. 2 illustrates a ground conductor pattern 13 constituting the patch antenna 10 while seeing through a dielectric substrate 20.

As illustrated in FIG. 3, the antenna module 1 includes the patch antennas 10, the RF signal processing circuit (RFIC) 3, and a resin member 40.

As illustrated in FIG. 2, the patch antenna 10 includes a first power feeding conductor pattern 11, a second power feeding conductor pattern 12, the ground conductor pattern 13, and the dielectric substrate 20.

As illustrated in FIG. 3, the first power feeding conductor pattern 11 is a conductor pattern that is formed on the dielectric substrate 20 so as to be substantially parallel to the main surface of the dielectric substrate 20, and a radio frequency signal is fed thereto from the RF signal processing circuit (RFIC) 3 after passing through a conductor via 15. In this embodiment, the first power feeding conductor pattern 11 has a rectangular shape when the dielectric substrate 20 is seen in a plan view.

As illustrated in FIG. 3, the second power feeding conductor pattern 12 is a conductor pattern that is formed on the dielectric substrate 20 so as to be substantially parallel to the main surface of the dielectric substrate 20 and is arranged to be isolated from the first power feeding conductor pattern 11 so as to interpose the first power feeding conductor pattern 11 in the polarization direction (Y-axis direction). More specifically, the second power feeding conductor pattern 12 is a rectangular annular conductor pattern arranged with a predetermined interval from the first power feeding conductor pattern 11 so as to surround the first power feeding conductor pattern 11 when the dielectric substrate 20 is seen in a plan view.

As illustrated in FIG. 3, the ground conductor pattern 13 is arranged on the dielectric substrate 20 so as to face the first power feeding conductor pattern 11 and the second power feeding conductor pattern 12 in the vertical line direction of the main surface of the dielectric substrate 20 and is set to have a ground potential.

The second power feeding conductor pattern 12 is not set to have the ground potential. Further, the second power feeding conductor pattern 12 is not connected to the ground conductor pattern 13.

Note that the planar shapes of the first power feeding conductor pattern 11 and the second power feeding conductor pattern 12 are not limited to the above shapes. The first power feeding conductor pattern 11 may have a circular shape and the second power feeding conductor pattern 12 may have an annular shape. Alternatively, the first power feeding conductor pattern 11 may have a polygonal shape and the second power feeding conductor pattern 12 may have a polygon annular shape. Further, the first power feeding conductor pattern 11 and the second power feeding conductor pattern 12 may have shapes other than those described above. It is preferable that an interval Gap between the first power feeding conductor pattern 11 and the second power feeding conductor pattern 12 be constant.

Further, the first power feeding conductor pattern 11, the second power feeding conductor pattern 12 and the ground conductor pattern 13 are formed of, for example, a metal film containing Al, Cu, Au, Ag, or an alloy thereof as a main component.

The dielectric substrate 20 has a structure that is filled with a dielectric material between the first power feeding conductor pattern 11 and the second power feeding conductor pattern 12 and the ground conductor pattern 13. The RF signal processing circuit (RFIC) 3 is arranged on a second main surface (back surface) of the dielectric substrate 20, which opposes the first main surface (surface). Note that the dielectric substrate 20 may be, for example, a low temperature co-fired ceramics (LTCC) substrate, a printed board, or the like. The dielectric substrate 20 may be simply a space that is not filled with the dielectric material. In this case, a structure for supporting the first power feeding conductor pattern 11 and the second power feeding conductor pattern 12 is required.

As illustrated in FIG. 3, the resin member 40 is a member for sealing the RF signal processing circuit (RFIC) 3 arranged on the second main surface (back surface) of the dielectric substrate 20.

Table 1 indicates dimensions and material parameters of the components forming the patch antenna 10 in the embodiment. Note that the dimensions and material parameters of the patch antenna according to the disclosure are merely examples and are not limited to those indicated in Table 1.

TABLE 1

| | |
|---|---|
| FIRST POWER FEEDING CONDUCTOR PATTERN 11 LENGTH L1x (mm), WIDTH L1y (mm) | 1.78 |
| SECOND POWER FEEDING CONDUCTOR PATTERN 12 LENGTH L2x (mm), WIDTH L2y (mm) | 1.88 |
| INTERVAL Gap (mm) BETWEEN FIRST POWER FEEDING CONDUCTOR PATTERN 11 AND SECOND POWER FEEDING CONDUCTOR PATTERN 12 | 0.05 |
| THICKNESS tc (μm) OF EACH CONDUCTOR PATTERN | 20 |

TABLE 1-continued

| | |
|---|---|
| THICKNESS (mm) OF DIELECTRIC SUBSTRATE 20 | 0.4 |
| RELATIVE PERMITTIVITY εr OF DIELECTRIC SUBSTRATE 20 | 3.5 |
| DIELECTRIC LOSS TANGENT tanδ OF DIELECTRIC SUBSTRATE 20 | 0.004 |

In the patch antenna 10, a power feed point of the radio frequency signal, that is, a connection point between the conductor via 15 and the first power feeding conductor pattern 11 deviates from a center point of the first power feeding conductor pattern 11 in the Y-axis direction. Therefore, the polarization direction of the patch antenna 10 is the Y-axis direction.

Here, in the patch antenna 10, the length L1$x$ of the first power feeding conductor pattern 11 that functions as a radiation plate is roughly expressed by the following Equation 1, where λg1 is the electric length.

$$L1x=\lambda g1/2 \quad \text{(Equation 1)}$$

Further, in the patch antenna 10, the length L2$x$ of the second power feeding conductor pattern 12 that functions as a radiation plate is roughly expressed by Equation 2, where the electric length in the case where the second power feeding conductor pattern 12 and the first power feeding conductor pattern 11 are coupled to each other with Gap=0 is λg2.

$$L2x=\lambda g2/2 \quad \text{(Equation 2)}$$

Further, the electrical lengths λg1 and λg2 are roughly expressed by the following Equations 3 and 4, where λ1 and λ2 are the wavelengths of the radio frequency signals that are spatially propagated.

$$\lambda g1=\lambda 1/\varepsilon r^{1/2} \quad \text{(Equation 3)}$$

$$\lambda g2=\lambda 2/\varepsilon r^{1/2} \quad \text{(Equation 4)}$$

In the patch antenna 10 having the above configuration, when a radio frequency signal is fed from the RF signal processing circuit (RFIC) 3 to the first power feeding conductor pattern 11, a radio frequency signal having a resonant frequency f1 defined by the electric length λg1 of the first power feeding conductor pattern 11 in the polarization direction (Y-axis direction) is radiated from the first power feeding conductor pattern 11 in directions about an X-axis positive direction (zenith direction). Further, a radio frequency signal having a resonant frequency f2 defined by the electric length λg2 of the first power feeding conductor pattern 11 and the second power feeding conductor pattern 12 in the polarization direction (Y-axis direction) is radiated from the first power feeding conductor pattern 11 and the second power feeding conductor pattern 12 in directions about the X-axis positive direction (zenith direction). Note that, with regard to the resonant frequency f2, strictly speaking, the above Equation 2 is not satisfied due to the presence of Gap between the first power feeding conductor pattern 11 and the second power feeding conductor pattern 12, and the electric length λg2 is changed by the degree of electromagnetic field coupling between the first power feeding conductor pattern 11 and the second power feeding conductor pattern 12.

[1.3 Reflection Characteristics and Radiation Characteristics of Patch Antenna]

Figure 4A:
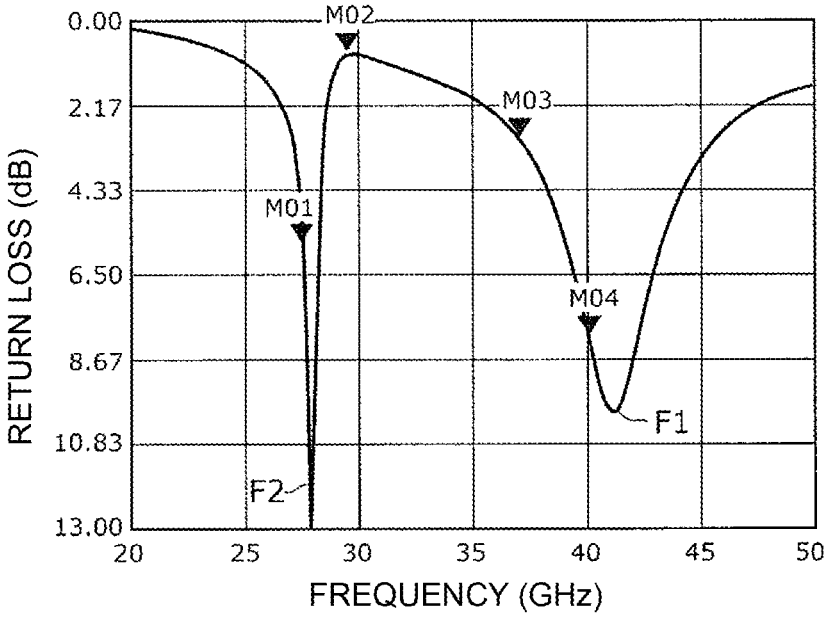
FIG. 4A is a graph illustrating reflection characteristics of the patch antenna according to the first embodiment.
Figure 4B:
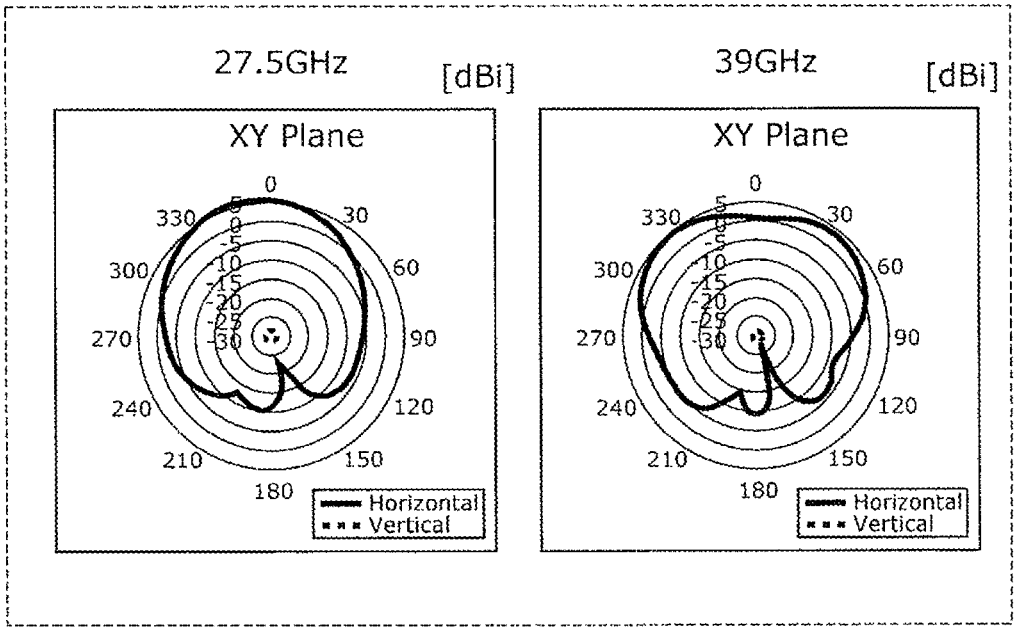
FIG. 4B is a graph illustrating radiation patterns of the patch antennas at two frequencies according to the first embodiment.
Figure 5:
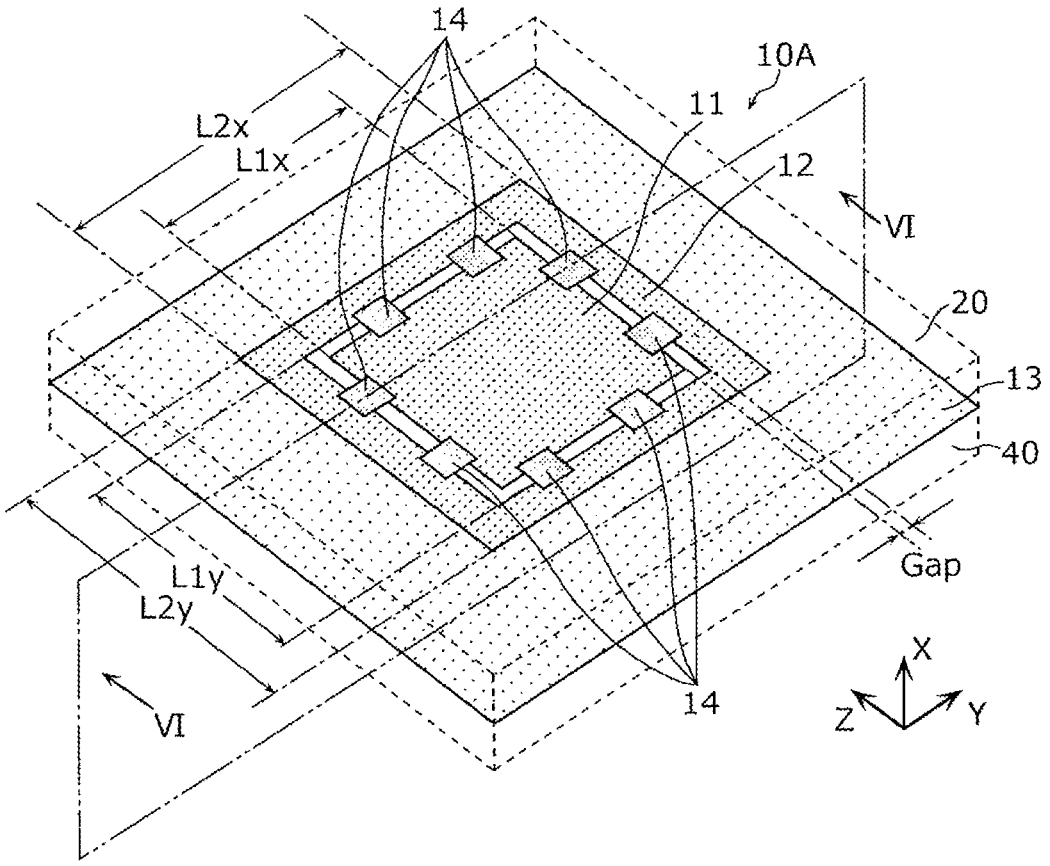
FIG. 5 is a perspective view illustrating an outer appearance of a patch antenna according to a second embodiment.

FIG. 4A is a graph illustrating reflection characteristics of the patch antenna 10 according to the first embodiment. FIG. 4B is a graph illustrating radiation patterns of the patch antenna 10 at two frequencies according to the first embodiment. FIG. 4A illustrates return loss of the patch antenna 10 when the power feed point (connection point between the first power feeding conductor pattern 11 and the conductor via 15) of the patch antenna 10 is seen from the (conductor via) 15. FIG. 5 illustrates radiation patterns (radiation intensity distributions) on an XY plane passing through the power feed point for the radio frequency signals having the resonant frequency f1 (39 GHz) and the resonant frequency f2 (27.5 GHz).

As illustrated in FIG. 4A, the return loss is maximum in the vicinity of the resonant frequency f1 (39 GHz) (F1 in FIG. 4A) defined by the first power feeding conductor pattern 11. At a maximum point in the vicinity of the resonant frequency f1 (39 GHz), as illustrated in the right side of FIG. 4B, radio wave radiation having directivity in the zenith direction (X-axis positive direction: 0° direction in FIG. 4B) from the first power feeding conductor pattern 11 is excited.

As illustrated in FIG. 4A, the return loss is maximum in the vicinity of the resonant frequency f2 (27.5 GHz) (F2 in FIG. 4A) defined by the first power feeding conductor pattern 11 and the second power feeding conductor pattern 12. At a maximum point in the vicinity of the resonant frequency f2 (27.5 GHz), as illustrated in the left side of FIG. 4B, radio wave radiation having directivity in the zenith direction (X-axis positive direction: 0° direction in FIG. 4B) from the first power feeding conductor pattern 11 and the second power feeding conductor pattern 12 is excited.

In the conventional two-frequency sharing antenna, since the second power feeding conductor pattern 12 is connected to the grounding conductor with the plurality of short pins interposed therebetween, the radio frequency current flowing through the second power feeding conductor pattern 12 also flows through the short pins and the ground conductor pattern 13. For this reason, the electric length and the current direction of the second power feeding conductor pattern 12 are not fixed, and it becomes difficult to set the resonant frequency f2 to the designed frequency. Further, the electric wave radiation direction at the resonant frequency f2 is directed also toward the lower elevation angle direction and the downward direction, resulting in a problem that the directivity in the zenith direction (the X-axis positive direction) is weakened.

On the other hand, with the patch antenna 10 according to the embodiment, the radiation characteristics of the radio frequency signal in the vicinity of the resonant frequency f1 defined by the first power feeding conductor pattern 11 have directivity in the zenith direction of the first power feeding conductor pattern 11 (vertical line direction on the opposite side to the ground conductor pattern 13 with respect to the first power feeding conductor pattern 11) with fundamental waves of the radio frequency signal. Moreover, the radiation characteristics of the radio frequency signal in the vicinity of the resonant frequency f2 defined by the first power feeding conductor pattern 11 and the second power feeding conductor pattern 12, which are electromagnetically coupled to each other with the above Gap therebetween, can have directivity in the zenith direction of the first power feeding conductor pattern 11 and the second power feeding conductor pattern 12 with the fundamental waves of the radio frequency signal because the second power feeding conductor pattern 12 is not connected to the ground. That is to say, it is possible to excite the radio frequency signals of a plurality of frequency bands and to ensure the directivity in the above zenith direction from the antenna plane in all of the plurality of frequency bands. Further, since all radiation is caused by the action with the fundamental waves, the radiation characteristics with a wide bandwidth can be provided.

Note that although the array antenna 4 is an antenna element including the plurality of patch antennas 10, the plurality of patch antennas 10 may be arrayed in the one-dimensional or two-dimensional manner on the dielectric substrate 20, and may share the dielectric substrate 20 and share the ground conductor pattern 13.

With this configuration, it is possible to form the array antenna 4 in which the plurality of patch antennas 10 is arranged in the one-dimensional or two-dimensional manner on the same dielectric substrate 20. Therefore, each patch antenna 10 can excite the radio frequency signals of the plurality of frequency bands and can ensure the directivity in the above zenith direction from the antenna plane in all of the plurality of frequency bands. Thus, it is possible to realize a phased array antenna which can control the directivity with an adjusted phase for each patch antenna 10.

Further, the antenna module 1 according to the disclosure may include the patch antennas 10 and a power feeding circuit that feeds a radio frequency signal to the first power feeding conductor pattern 11, the first power feeding conductor pattern 11 and the second power feeding conductor pattern 12 may be formed on the first main surface of the dielectric substrate 20, the ground conductor pattern 13 may be formed on the second main surface of the dielectric substrate 20, which opposes the first main surface, and the power feeding circuit may be formed on the second main surface side of the dielectric substrate 20.

With this configuration, it is possible to realize a small-sized antenna module having directivity to the first main surface side (zenith direction) in the vertical line direction of the dielectric substrate 20.

The communication apparatus 5 according to the disclosure includes the patch antennas 10 and the RF signal processing circuit 3. The RF signal processing circuit 3 includes the phase shifters 35A to 35D for shifting the phases of the radio frequency signals, the power amplifiers 32AT to 32DT and the low noise amplifiers 32AR to 32DR for amplifying the radio frequency signals, and the switches 31A to 31D for switching the connection between the signal paths through which the radio frequency signals propagate and the patch antennas 10.

With this configuration, it is possible to realize a multi-band/multi-mode communication device capable of controlling directivity of antenna gain characteristics and providing radiation characteristics with a widened bandwidth.

Second Embodiment

In the patch antenna 10 according to the first embodiment, the first power feeding conductor pattern 11 and the second power feeding conductor pattern 12 are arranged with only Gap interposed therebetween. A patch antenna 10A according to the embodiment has a configuration in which the first power feeding conductor pattern 11 and the second power feeding conductor pattern 12 are connected with an impedance element interposed therebetween.

[2.1 Configuration of Patch Antenna]

Figure 6:
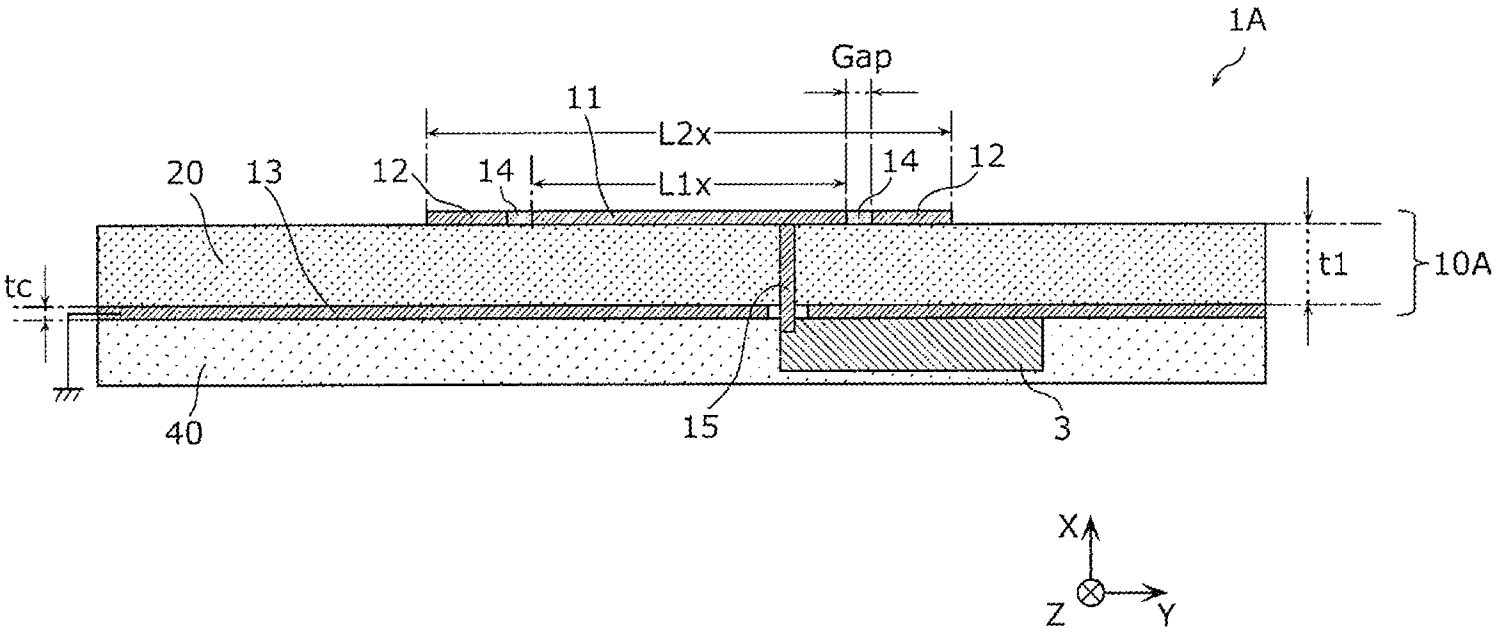
FIG. 6 is a cross-sectional view of an antenna module according to the second embodiment.

FIG. 5 is a perspective view illustrating an outer appearance of the patch antenna 10A according to a second embodiment. FIG. 6 is a cross-sectional view of an antenna module 1A according to the second embodiment. FIG. 6 is a cross-sectional view taken along a line VI-VI of FIG. 5. FIG. 5 illustrates the ground conductor pattern 13 constituting the patch antenna 10A while seeing through the dielectric substrate 20.

As illustrated in FIG. 6, the antenna module 1A includes the patch antenna 10A, the RF signal processing circuit (RFIC) 3, and the resin member 40.

The patch antenna 10A according to the embodiment is different from the patch antenna 10 according to the first embodiment in that impedance elements 14 are arranged between the first power feeding conductor pattern 11 and the second power feeding conductor pattern 12. Hereinafter, points of the patch antenna 10A, which are different from those of the patch antenna 10 according to first embodiment, will be mainly described while omitting the same points.

As illustrated in FIG. 5, the patch antenna 10A includes the first power feeding conductor pattern 11, the second power feeding conductor pattern 12, the ground conductor pattern 13, the impedance elements 14, and the dielectric substrate 20.

The first power feeding conductor pattern 11, the second power feeding conductor pattern 12, and the ground conductor pattern 13 have the same configurations as those in the first embodiment.

The second power feeding conductor pattern 12 is not set to have the ground potential. Further, the second power feeding conductor pattern 12 is not connected to the ground conductor pattern 13.

The dielectric substrate 20 and the resin member 40 have the same configurations as those in the first embodiment.

Table 2 indicates dimensions and material parameters of the components forming the patch antenna 10A according to the embodiment. In Table 2, only the length L2*x* and the width L2*y* (mm) of the second power feeding conductor pattern 12 are different from those of the first embodiment (Table 1).

TABLE 1

| | |
|---|---|
| FIRST POWER FEEDING CONDUCTOR PATTERN 11 LENGTH L1x (mm), WIDTH L1y (mm) | 1.78 |
| SECOND POWER FEEDING CONDUCTOR PATTERN 12 LENGTH L2x (mm), WIDTH L2y (mm) | 2.54 |
| Gap (mm) BETWEEN FIRST POWER FEEDING CONDUCTOR PATTERN 11 AND SECOND POWER FEEDING CONDUCTOR PATTERN 12 | 0.05 |
| THICKNESS tc (μm) OF EACH CONDUCTOR PATTERN | 20 |
| THICKNESS (mm) OF DIELECTRIC SUBSTRATE 20 | 0.4 |
| RELATIVE PERMITTIVITY εr OF DIELECTRIC SUBSTRATE 20 | 3.5 |
| DIELECTRIC LOSS TANGENT tanδ OF DIELECTRIC SUBSTRATE 20 | 0.004 |

The impedance elements 14 are arranged between the first power feeding conductor pattern 11 and the second power feeding conductor pattern 12 and connect the first power feeding conductor pattern 11 to the second power feeding conductor pattern 12. Impedances of the impedance elements 14 at the resonant frequency f2 are lower than impedances of the impedance elements 14 at the resonant frequency f1.

In the patch antenna 10A having the above configuration, when a radio frequency signal is fed from the RF signal processing circuit (RFIC) 3 to the first power feeding conductor pattern 11, a radio frequency signal having the resonant frequency f1 defined by the electrical length λg1 of the first power feeding conductor pattern 11 is radiated from the first power feeding conductor pattern 11 in directions about an X-axis positive direction (zenith direction). Further, a radio frequency signal having the resonant frequency f2 defined by the electric length λg2 of the first power feeding conductor pattern 11 and the second power feeding conductor pattern 12 is radiated from the first power feeding conductor pattern 11 and the second power feeding conductor pattern 12 in directions about the X-axis positive direction (zenith direction). The impedance elements 14 have high impedances at the resonant frequency f1, so that the second power feeding conductor pattern 12 cannot function as a conductor pattern and the above Equation 1 can be applied substantially. The impedance elements 14 have low impedances at the resonant frequency f2, so that the first power feeding conductor pattern 11 and the second power feeding conductor pattern 12 can tend to function as an integral conductor pattern and the above Equation 2 can be applied substantially. In this case, Equation 5 is established from Equations 1 and 2.

$$\text{Resonant frequency } f2 < \text{resonant frequency } f1 \qquad \text{(Equation 5)}$$

In other words, the impedance elements 14 have characteristics of having low impedances in a low frequency band including the resonant frequency f2 and high impedances in a high frequency band including the resonant frequency f1. Here, the circuit configuration and impedance characteristics of the impedance element will be described.

Figure 7A:
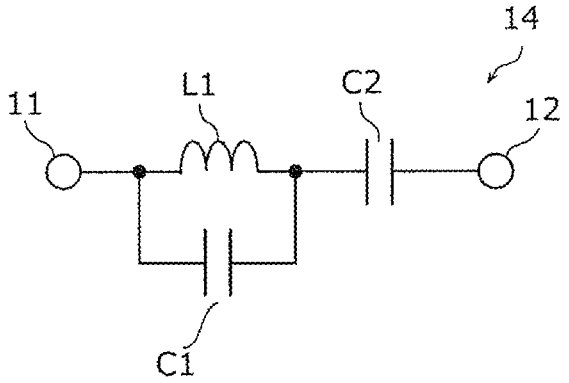
FIG. 7A is a circuit configuration diagram of an impedance element according to the second embodiment.

FIG. 7A is a diagram illustrating an example of the circuit configuration of each impedance element 14 according to the second embodiment. As illustrated in FIG. 7A, the impedance element 14 constitutes an LC resonance circuit having an inductor L1 and capacitors C1, C2. More specifically, a circuit, in which the inductor L1 and the capacitor C1 are connected in parallel, and a capacitor C2 are connected in series between the first power feeding conductor pattern 11 and the second power feeding conductor pattern 12. Table 3 indicates circuit constants of the inductor L1 and the capacitors C1, C2 used in the embodiment. Since the impedance element 14 is constituted by the LC resonance circuit, it can be formed using a conductor pattern and a dielectric substrate, so that the impedance element 14 can be reduced in size.

TABLE 3

| | |
|---|---|
| CAPACITOR C1 (pF) | 0.172 |
| CAPACITOR C2 (pF) | 0.13 |
| INDUCTOR L1 (nH) | 0.102 |

Figure 7B:
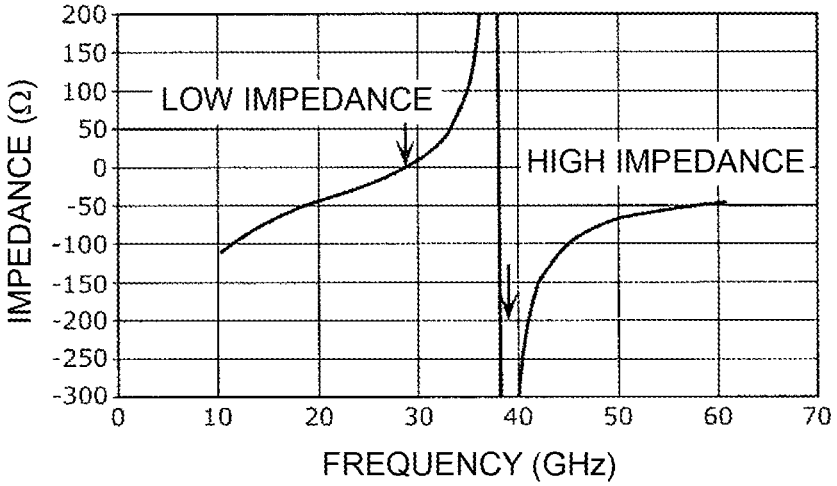
FIG. 7B is a graph illustrating frequency characteristics of the impedance element according to the second embodiment.

FIG. 7B is a graph illustrating frequency characteristics of the impedance element 14 according to the second embodiment. As illustrated in FIG. 7B, the impedance of the impedance element 14 has a resonance point and an anti-resonance point in a frequency band of 30 GHz to 40 GHz. Therefore, the impedance of the impedance element 14 is low at 28.5 GHz (approximately 0Ω in FIG. 7B) and is high at 39 GHz (approximately equal to or lower than −300Ω in FIG. 7B). Note that the high impedance is defined as a case in which an absolute value of the impedance illustrated in FIG. 7B is large and the low impedance is defined as a case in which the absolute value of the impedance illustrated in FIG. 7B is small.

In other words, the circuit configuration of the impedance element 14 is appropriately set such that a frequency at which the impedance is low is the resonant frequency f2 of the patch antenna 10A and a frequency at which the impedance is high is the resonant frequency f1 of the patch antenna 10A.

[2.2 Reflection Characteristics and Radiation Characteristics of Patch Antenna]

Figure 8A:
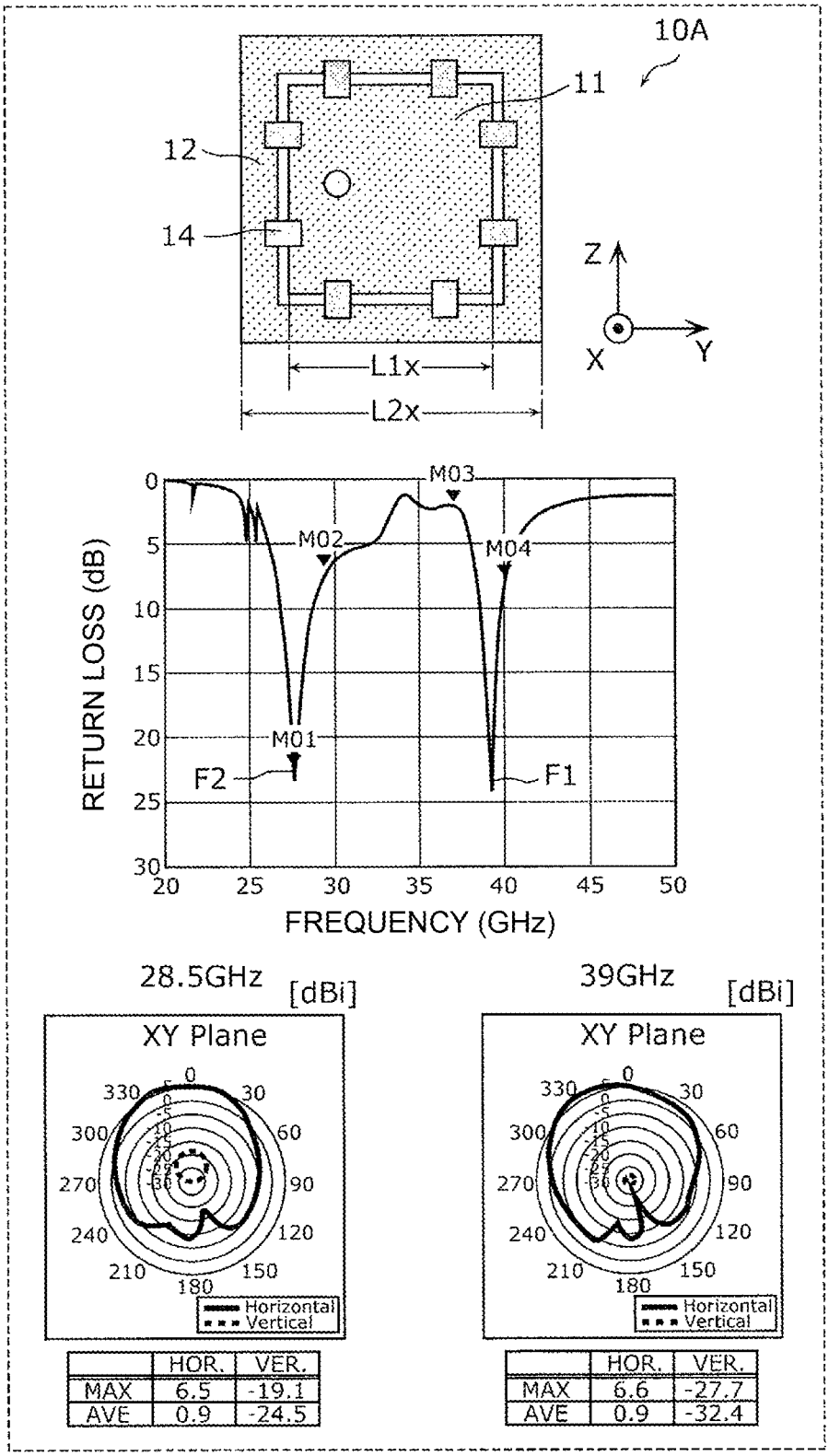
FIG. 8A is a graph illustrating reflection characteristics of the patch antenna and radiation patterns thereof at two frequencies according to the second embodiment.

FIG. 8A is a graph illustrating reflection characteristics of the patch antenna 10A and radiation patterns thereof at two frequencies according to the second embodiment. A middle portion of FIG. 8A illustrates the reflection characteristics of the patch antenna 10A when the power feed point of the patch antenna 10A (the connection point between the first power feeding conductor pattern 11 and the conductor via 15) is seen from the conductor via 15. A lower stage of FIG. 8A illustrates the radiation patterns (radiation intensity distributions) on the XY plane passing through the power feed point for the radio frequency signals in the vicinity of the resonant frequency f1 (39 GHz) and in the vicinity of the resonant frequency f2 (28.5 GHz).

Eight impedance elements 14 in total are arranged in the patch antenna 10A. More specifically, two impedance elements 14 are arranged on each side of a rectangular annular Gap between the first power feeding conductor pattern 11 and the second power feeding conductor pattern 12.

As illustrated in the middle portion of FIG. 8A, return loss is maximum in the vicinity of the resonant frequency f1 (39 GHz) (F1 in FIG. 8A) defined by the first power feeding conductor pattern 11. At a maximum point in the vicinity of the resonant frequency f1 (39 GHz), as illustrated in the lower portion of FIG. 8A, the radio wave radiation having the directivity in the zenith direction (X-axis positive direction: 0° direction in FIG. 8A) from the first power feeding conductor pattern 11 is excited.

As illustrated in the middle portion of FIG. 8A, the return loss is maximum in the vicinity of the resonant frequency f2 (28.5 GHz) (F2 in FIG. 8A) defined by the first power feeding conductor pattern 11 and the second power feeding conductor pattern 12. At a maximum point in the vicinity of the resonant frequency f2 (28.5 GHz), as illustrated in the lower portion of FIG. 8A, the radio wave radiation having the directivity in the zenith direction (X-axis positive direction: 0° direction in FIG. 8A) from the first power feeding conductor pattern 11 and the second power feeding conductor pattern 12 is excited.

In the conventional two-frequency sharing antenna, since the second power feeding conductor pattern 12 is connected to the grounding conductor with the plurality of short pins interposed therebetween, the radio frequency current flowing through the second power feeding conductor pattern 12 also flows through the short pins and the ground conductor pattern 13. Therefore, the electrical length and the current direction of the second power feeding conductor pattern 12 are not fixed, it becomes difficult to set the resonant frequency f2 to a designed frequency, and the electric wave radiation direction in the vicinity of the resonant frequency f2 is directed also toward the lower elevation angle direction and the downward direction, resulting in a problem that the directivity in the zenith direction (the X-axis positive direction) is weakened.

On the other hand, with the patch antenna 10A according to the embodiment, since the impedance elements 14 have the high impedances in the vicinity of the resonant frequency f1 defined by the first power feeding conductor pattern 11, the current flowing through the first power feeding conductor pattern 11 does not flow through the second power feeding conductor pattern 12. Therefore, the resonant frequency f1 is substantially defined by the electric length λg1 indicated in Equation 1, and the radiation pattern in the vicinity of the resonant frequency f1 has the directivity in the zenith direction of the first power feeding conductor pattern 11 (vertical line direction on the opposite side to the ground conductor pattern 13 with respect to the first power feeding conductor pattern 11) by the action of the fundamental waves.

The impedance elements 14 have the low impedances in the vicinity of the resonant frequency f2 defined by the first power feeding conductor pattern 11 and the second power feeding conductor pattern 12, and the second power feeding conductor pattern 12 is not grounded. Therefore, the current flowing through the first power feeding conductor pattern 11 also flows through the second power feeding conductor pattern 12, the resonant frequency f2 is substantially defined by the electric length λg2 indicated in Equation 2, and the radiation pattern in the vicinity of the resonant frequency f2 has the directivity in the above zenith direction of the first power feeding conductor pattern 11 and the second power feeding conductor pattern 12 by the action of the fundamental waves.

That is to say, it is possible to excite the radio frequency signals of the plurality of frequency bands and to ensure the directivity in the above zenith direction from the antenna plane in all of the plurality of frequency bands. Further, since all radiation is caused by the action with the fundamental waves, the radiation characteristics with a wide bandwidth can be provided.

[2.3 Arrangement Layout of Impedance Elements]

Next, reflection characteristics and radiation characteristics of the patch antenna in a case where an arrangement layout of the plurality of impedance elements 14 is changed will be described.

Figure 8B:
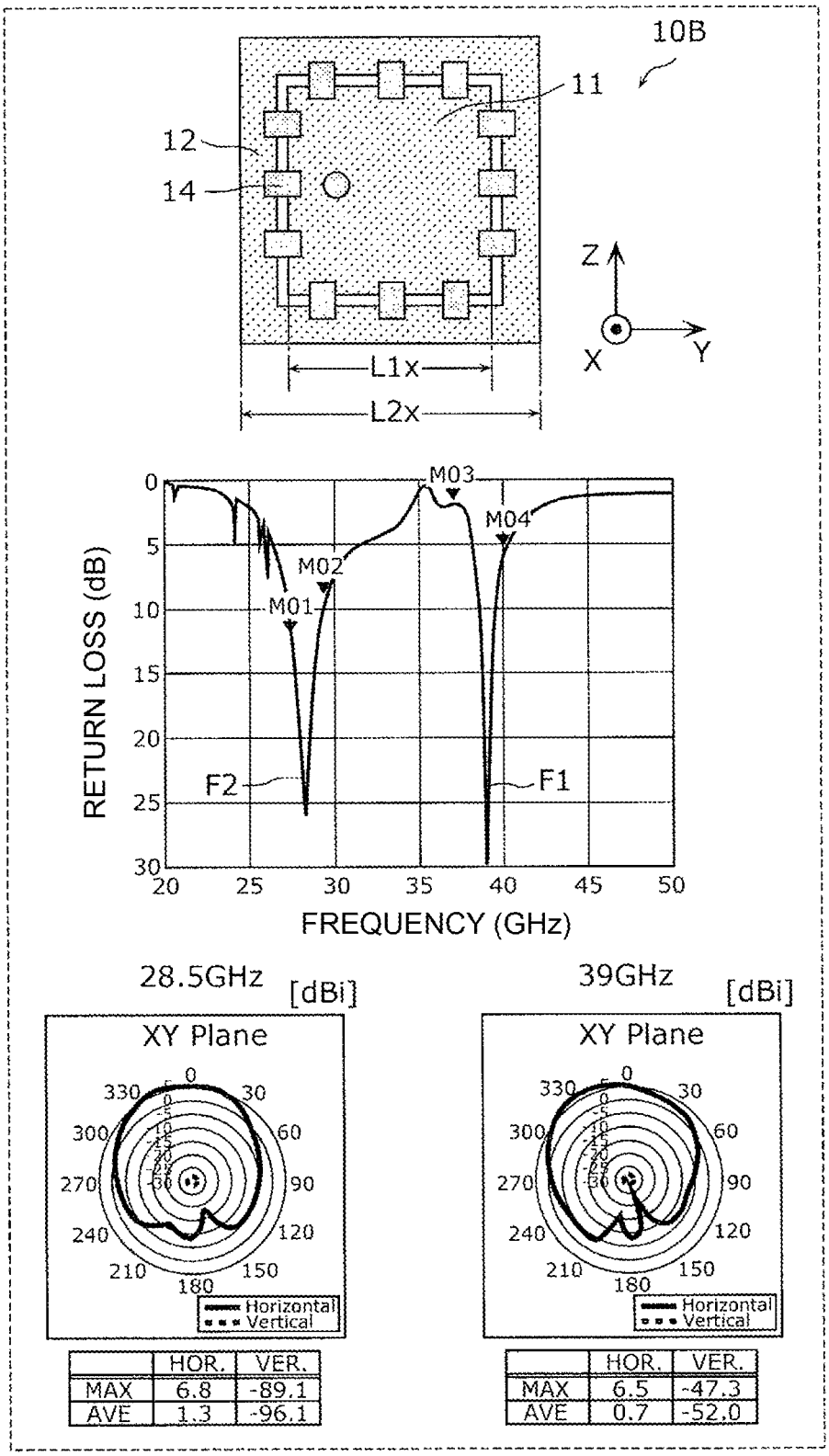
FIG. 8B is a graph illustrating reflection characteristics of a patch antenna and radiation patterns thereof at two frequencies according to a first variation of the second embodiment.

FIG. 8B is a graph illustrating reflection characteristics of a patch antenna 10B and radiation patterns thereof at two frequencies according to a first variation of the second embodiment. In the patch antenna 10B according to this variation, the number of the arranged impedance elements 14 is different from that of the patch antenna 10A according to the second embodiment.

In the patch antenna 10A, the eight impedance elements 14 are arranged in total while in the patch antenna 10B, twelve impedance elements 14 in total are arranged. More specifically, in the patch antenna 10B, three impedance elements 14 are arranged on each side of the rectangular annular Gap between the first power feeding conductor pattern 11 and the second power feeding conductor pattern 12.

As illustrated in a middle portion of FIG. 8B, return loss is maximum in the vicinity of the resonant frequency f1 (39 GHz) (F1 in FIG. 8B) defined by the first power feeding conductor pattern 11. At a maximum point in the vicinity of the resonant frequency f1 (39 GHz), as illustrated in a lower portion of FIG. 8B, radio wave radiation having directivity in the zenith direction (X-axis positive direction: 0° direction in FIG. 8B) from the first power feeding conductor pattern 11 is excited.

As illustrated in the middle portion of FIG. 8B, the return loss is maximum in the vicinity of the resonant frequency f2 (28.5 GHz) (F2 in FIG. 8B) defined by the first power feeding conductor pattern 11 and the second power feeding conductor pattern 12, and the return loss at the resonant frequency f2 (28.5 GHz) is larger than that of the patch antenna 10A according to the second embodiment. At a maximum point in the vicinity of the resonant frequency f2 (28.5 GHz), as illustrated in the lower portion of FIG. 8B, the radio wave radiation having the directivity in the zenith direction (X-axis positive direction: 0° direction in FIG. 8B) from the first power feeding conductor pattern 11 and the second power feeding conductor pattern 12 is excited. In addition, the radiation intensity (Max 6.8 dBi, Ave 1.3 dBi) at the resonant frequency f2 (28.5 GHz) is higher than that of the patch antenna 10A according to the second embodiment.

With the patch antenna 10B according to the variation, at the resonant frequency f2 defined by the first power feeding conductor pattern 11 and the second power feeding conductor pattern 12, the impedance is lower than that of the patch antenna 10A because a larger number of impedance elements 14 are connected in parallel. Further, the second power feeding conductor pattern 12 is not grounded. Therefore, the radiation pattern in the vicinity of the resonant frequency f2 has the directivity in the above zenith direction by the action of the fundamental waves, and it is possible to increase the peak intensity in the radiation pattern. In other words, as the number of the connected impedance elements 14 increases, it is possible to ensure the directivity in the above zenith direction from the antenna plane and to increase the peak intensity.

As described above, it has been described that arrangement of the more impedance elements 14 is preferable in terms of the antenna radiation characteristics. Further, it is preferable that a larger number of impedance elements 14 be arranged on a side orthogonal to the polarization direction (Y-axis direction) in the rectangular annular Gap between the first power feeding conductor pattern 11 and the second power feeding conductor pattern 12. When a slit region (region where no impedance element 14 is arranged) is larger on the side orthogonal to the polarization direction (Y-axis direction) of the above Gap, a cross polarization current intersecting with the polarization direction flows in the vicinity of the slit region. Thus, the peak intensity of the antenna radiation of main polarized waves deteriorates. In view of the above points, preferably, the number of the arranged impedance elements 14 is large, and more preferably, the more impedance elements 14 are arranged on the side orthogonal to the polarization direction (Y-axis direction) in the above Gap.

[2.4 Patch Antenna 10C According to Second Variation]

Figure 9:
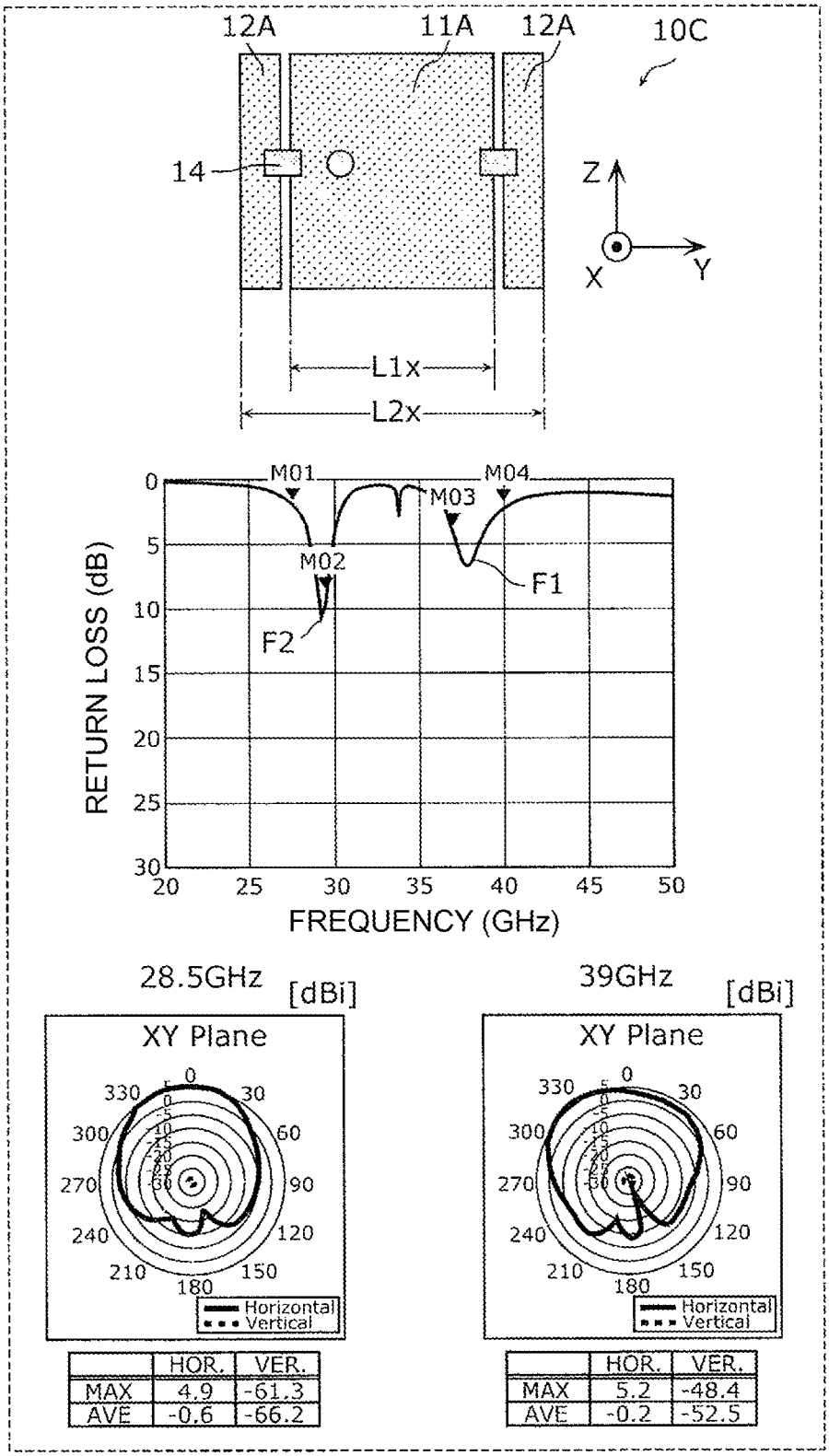
FIG. 9 is a graph illustrating reflection characteristics of a patch antenna and radiation patterns thereof at two frequencies according to a second variation of the second embodiment.

FIG. 9 is a graph illustrating reflection characteristics of a patch antenna 10C and radiation patterns thereof at two frequencies according to a second variation of the second embodiment. In the patch antenna 10C according to this variation, shapes of second power feeding conductor patterns 12A and the number of the arranged impedance elements 14 are different from those of the patch antenna 10A according to the second embodiment. More specifically, in the patch antenna 10A, the second power feeding conductor pattern 12 is the annular conductor pattern that is arranged so as to surround the first power feeding conductor pattern 11. On the other hand, in the patch antenna 10C according to the variation, two second power feeding conductor patterns 12A are arranged to be isolated from a first power feeding conductor pattern 11A so as to interpose the first power feeding conductor pattern 11A therebetween in the polarization direction.

As illustrated in a middle portion of FIG. 9, return loss is maximum in the vicinity of the resonant frequency f1 (F1 in FIG. 9) defined by the first power feeding conductor pattern 11A. At a maximum point in the vicinity of the resonant frequency f1 (39 GHz), as illustrated in a lower portion of FIG. 9, radio wave radiation having the directivity in the zenith direction (X-axis positive direction: 0° direction in FIG. 9) from the first power feeding conductor pattern 11A is excited.

As illustrated in the middle portion of FIG. 9, the return loss is maximum in the vicinity of the resonant frequency f2 (F2 in FIG. 9) defined by the first power feeding conductor pattern 11A and the second power feeding conductor patterns 12A. At a maximum point in the vicinity of the resonant frequency f2 (28.5 GHz), as illustrated in the lower portion of FIG. 9, the radio wave radiation having directivity in the zenith direction (X-axis positive direction: 0° direction in FIG. 9) from the first power feeding conductor pattern 11A and the second power feeding conductor patterns 12A is excited.

With the patch antenna 10C according to the variation, since the impedance elements 14 have high impedances in the vicinity of the resonant frequency f1 defined by the first power feeding conductor pattern 11A, a current flowing through the first power feeding conductor pattern 11A does not flow through the second power feeding conductor patterns 12A. Therefore, the resonant frequency f1 is substantially defined by the electric length λg1 indicated in Equation 1, and the radiation pattern in the vicinity of the resonant frequency f1 has the directivity in the zenith direction of the first power feeding conductor pattern 11A (vertical line direction on the opposite side to the ground conductor pattern 13 with respect to the first power feeding conductor pattern 11A) by the action of the fundamental waves.

In addition, the impedance elements 14 have low impedances in the vicinity of the resonant frequency f2 defined by the first power feeding conductor pattern 11A and the second power feeding conductor patterns 12A, and the second power feeding conductor patterns 12A are not grounded. Therefore, the current flowing through the first power feeding conductor pattern 11A also flows through the second power feeding conductor patterns 12A, the resonant frequency f2 is substantially defined by the electric length λg2 indicated in Equation 2, and the radiation pattern in the vicinity of the resonant frequency f2 has the directivity in the above zenith direction by the action of the fundamental waves. That is to say, it is possible to excite the radio frequency signals of the plurality of frequency bands and to ensure the directivity in the above zenith direction from the antenna plane in all of the plurality of frequency bands. Further, since all radiation is caused by the action with the fundamental waves, the radiation characteristics with a wide bandwidth can be provided.

However, the return losses in the vicinity of the resonant frequency f2 (28.5 GHz) (F2) and in the vicinity of the resonant frequency f1 (39 GHz) (F1) are smaller than those of the patch antenna 10A according to the second embodiment. In addition, the radiation intensity (Max 4.9 dBi, Ave −0.6 dBi) in the vicinity of the resonant frequency f2 (28.5 GHz) and the radiation intensity (Max 5.2 dBi, Ave −0.2 dBi) in the vicinity of the resonant frequency f1 (39 GHz) are lower than those of the patch antenna 10A.

On the other hand, by increasing the number of impedance elements 14 arranged in Gap between the first power feeding conductor pattern 11A and the second power feeding conductor patterns 12A, it is possible to increase the radiation intensity in the vicinity of the resonant frequency f1 and the resonant frequency f2.

[2.5 Patch Antenna According to Comparative Example]

Figure 10A:
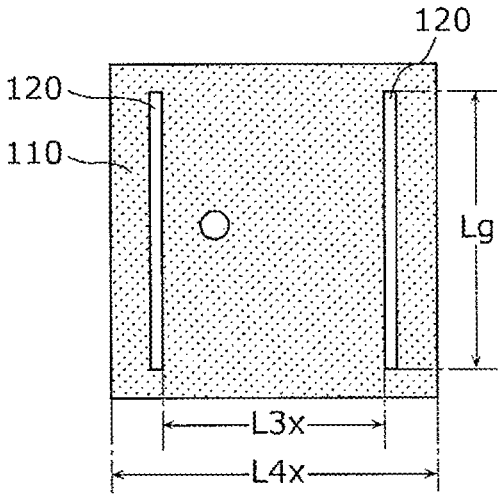
FIG. 10A is a plan view of a power feeding conductor pattern of a patch antenna according to a comparative example.

FIG. 10A is a plan view of a power feeding conductor pattern of a patch antenna according to a comparative example. In the patch antenna according to the comparative example illustrated in FIG. 10A, portions of a second power feeding conductor pattern arranged at both ends in the polarization direction (Y-axis positive direction) interpose a first power feeding conductor pattern with slits 120 interposed therebetween, and the second power feeding conductor pattern and the first power feeding conductor pattern are short-circuited in the direction intersecting with the polarization direction, unlike the patch antenna 10C according to the second variation. In other words, the first power feeding conductor pattern and the second power feeding conductor pattern are not isolated from each other. Further, no impedance element 14 is arranged.

Table 4 indicates dimensions and material parameters of the components forming the patch antenna according to the comparative example.

TABLE 4

| | |
|---|---|
| POWER FEEDING CONDUCTOR PATTERN 110 LENGTH (mm), WIDTH (mm) | 2.5 |
| SLIT 120 LENGTH Lg (mm) | 2.16 |
| SLIT 120 INTERVAL L3x (mm) | 1.96 |
| THICKNESS tc (μm) OF EACH CONDUCTOR PATTERN 20 | |
| THICKNESS (mm) OF DIELECTRIC SUBSTRATE 20 | 0.4 |
| RELATIVE PERMITTIVITY εr OF DIELECTRIC SUBSTRATE 20 | 3.5 |
| DIELECTRIC LOSS TANGENT tanδ OF DIELECTRIC SUBSTRATE 20 | 0.004 |

Figure 10B:
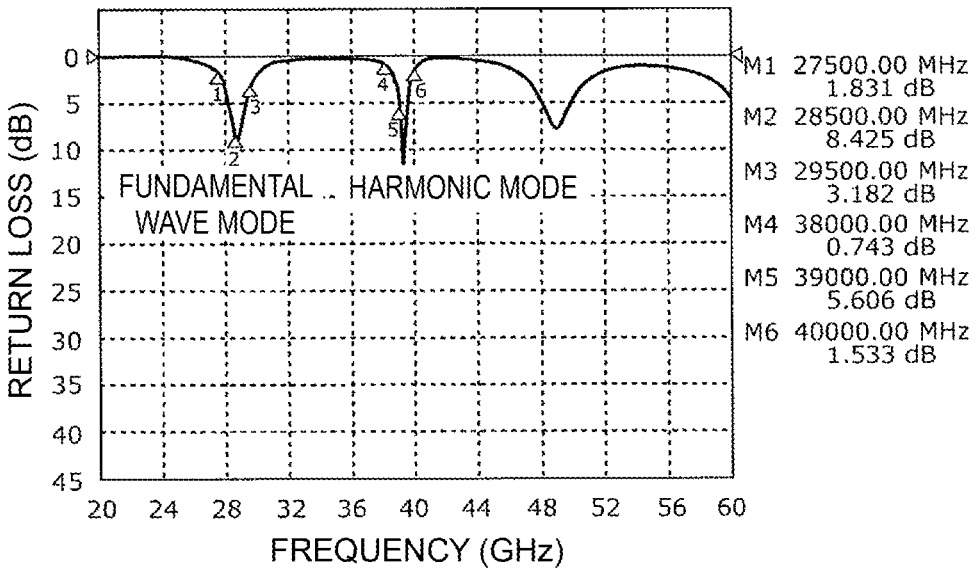
FIG. 10B is a graph illustrating reflection characteristics of the patch antenna according to the comparative example.

FIG. 10B is a graph illustrating reflection characteristics of the patch antenna according to the comparative example. As illustrated in FIG. 10B, in the reflection characteristics of the patch antenna according to the comparative example, maximum points of return loss are generated in the vicinity of the resonant frequency f2 and the vicinity of the resonant frequency f1. At the maximum point in the vicinity of the resonant frequency f2 (29 GHz), radio wave radiation having directivity in the zenith direction from the power feeding conductor pattern 110 is excited by a fundamental wave mode. On the other hand, at the maximum point in the vicinity of the resonant frequency f1 (39 GHz), a harmonic mode is excited by arrangement of the slits 120, and the radiation pattern therefore takes a minimum value of the radiation intensity in the zenith direction of the power feeding conductor pattern 110.

In addition, antenna gain in the vicinity of the resonant frequency f1 (39 GHz) is lower than those of the patch antennas 10A, 10B, and 10C according to the second embodiment.

By contrast, in the patch antennas 10A, 10B and 10C according to the embodiment, the second power feeding conductor pattern is arranged to be isolated from the first power feeding conductor pattern so as to interpose the first power feeding conductor pattern in the polarization direction when the dielectric substrate 20 is seen in the plan view. Further, the second power feeding conductor pattern is not set to have the ground potential.

With this configuration, the radiation characteristics of the radio frequency signal having the first resonant frequency defined by the first power feeding conductor pattern have the directivity in the above zenith direction of the first power feeding conductor pattern with the fundamental waves of the radio frequency signal. Moreover, at the vicinity of the resonant frequency f2, the radiation characteristics of the radio frequency signal in the vicinity of the second resonant frequency defined by the first power feeding conductor pattern and the second power feeding conductor pattern whose electrical conductivities are improved by the impedance elements have the directivity in the above zenith direction with the fundamental waves of the radio frequency signal because the second power feeding conductor pattern is not grounded. That is to say, it is possible to excite the radio frequency signals of the plurality of frequency bands and to ensure the directivity in the above zenith direction from the antenna plane in all of the plurality of frequency bands. Further, since all radiation is caused by the action with the fundamental waves, the radiation characteristics with a wide bandwidth can be provided.

Other Embodiments

While the antenna element, the antenna module, and the communication apparatus according to the embodiments of the disclosure have been described above with reference to the first embodiment and the second embodiment, the antenna element, the antenna module, and the communication apparatus according to the disclosure are not limited to the above-described embodiments. Other embodiments which are realized by combining desired components in the above-described embodiments, variations which can be obtained by performing, on the above-described embodiments, various modifications that those skilled in the art can conceive without departing from the spirit of the disclosure, and variations apparatuses incorporating the antenna element, the antenna module, and the communication apparatus of the present disclosure are also encompassed in the disclosure.

For example, the antenna element according to the disclosure may include a so-called notch antenna or a dipole antenna in addition to the patch antenna described in the above embodiments.

Figure 11A:
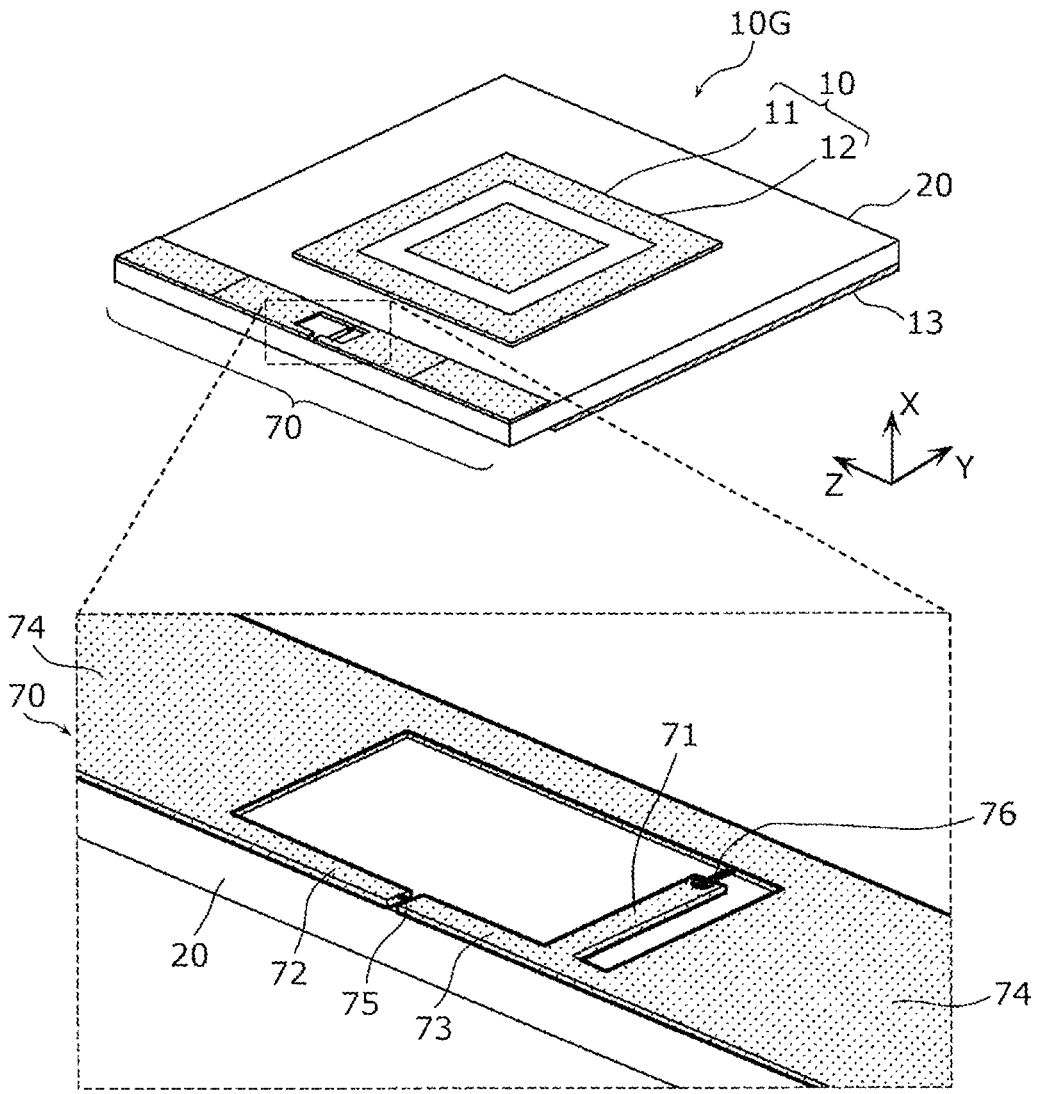
FIG. 11A is a perspective view illustrating an outer appearance of an antenna element according to another embodiment.

FIG. 11A is a perspective view illustrating an outer appearance of an antenna 10G according to another embodiment. The antenna 10G illustrated in FIG. 11A includes the patch antenna 10 and a notch antenna 70. The patch antenna 10, 10A, 10B, or 10C according to any one of the above-described embodiments is applied to the patch antenna 10. The notch antenna 70 is formed in an outer peripheral portion of the patch antenna 10. More specifically, conductor patterns of the notch antenna 70 are formed on the surface of the dielectric substrate 20 (the surface on which the first power feeding conductor pattern 11 and the second power feeding conductor pattern 12 are formed). As an example, as illustrated in FIG. 11A, the notch antenna 70 is arranged at an end side of the antenna 10G, which intersects with the polarization direction (X-axis direction) of the patch antenna 10. Note that the conductor patterns of the notch antenna 70 may be formed inside the dielectric substrate 20.

The notch antenna 70 includes a planar ground conductor pattern 74 (second ground pattern) formed on the surface, a ground non-formation region interposed between portions of the ground conductor pattern 74, radiation electrodes 72 and 73 arranged on the surface in the ground non-formation region, a power feeding line 71, and capacitive elements 75 and 76. A radio frequency signal fed to the power feeding line 71 is radiated from the radiation electrodes 72 and 73. While the patch antenna 10 has the directivity in the zenith direction (elevation direction: the vertical upward direction of the dielectric substrate 20), the notch antenna 70 has directivity in the direction in which the notch antenna 70 is arranged (i.e., in the azimuth direction: Y-axis negative direction) from a center portion of the antenna 10G. It is preferable that no ground conductor pattern be formed in a region of the back surface of the dielectric substrate 20, which opposes the ground conductor pattern 74 and the ground non-formation region.

With the above configuration, since the notch antenna 70 is formed, the ground conductor pattern 74 is formed, so that heat radiation efficiency is increased. Further, by combining the notch antenna 70 and the patch antenna 10, it is possible to support different frequency bands, so that a multi-band antenna can be easily designed. Moreover, since the area of the ground conductor pattern of the notch antenna 70 may be smaller than that of the dipole antenna, it is advantageous in that the area of the notch antenna 70 is reduced.

Figure 11B:
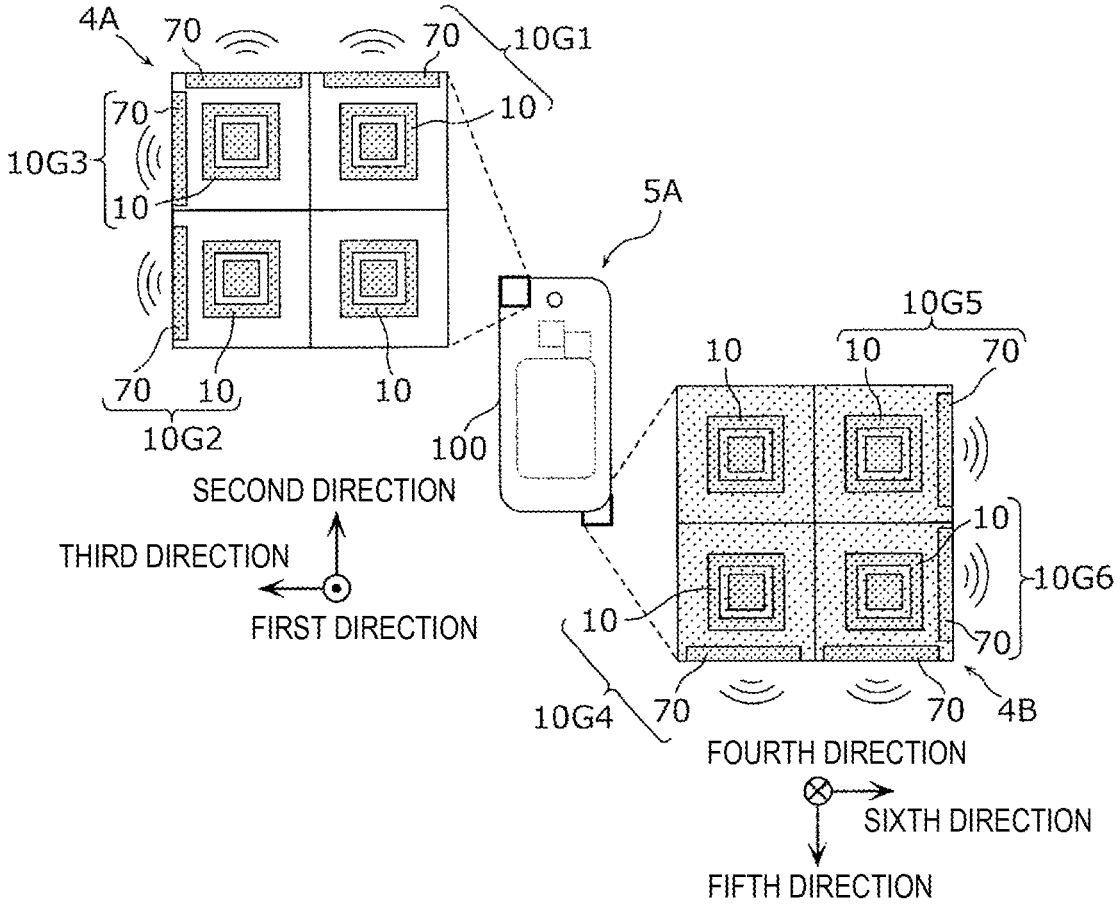
FIG. 11B is a schematic view of a mobile terminal in which the antenna elements according to another embodiment are arranged.

FIG. 11B is a schematic diagram of a mobile terminal 5A in which the antennas 10G are arranged. FIG. 11B illustrates the mobile terminal 5A and array antennas 4A and 4B arranged in the mobile terminal 5A. In addition to the array antennas 4A and 4B, an RF signal processing circuit that feeds a radio frequency signal to the array antennas 4A and 4B is arranged in the mobile terminal 5A.

As illustrated in FIG. 11B, the mobile terminal 5A includes a housing 100 in which the array antennas 4A and 4B and the RF signal processing circuit are arranged. The housing 100 is a hexahedron having a first outer peripheral surface as a main surface (e.g., a surface on which an operation panel is arranged), a second outer peripheral surface opposing the first outer peripheral surface, a third outer peripheral surface (e.g., an upper side surface in FIG. 11B) perpendicular to the first outer peripheral surface, a fourth outer peripheral surface (e.g., a lower side surface in FIG. 11B) opposing the third outer peripheral surface, a fifth outer peripheral surface (e.g., a left side surface in FIG. 11B) perpendicular to the first outer peripheral surface and the third outer peripheral surface, and a sixth outer peripheral surface (e.g., a right side surface in FIG. 11B) opposing the fifth outer peripheral surface. Note that the housing 100 may not be a rectangular parallelepiped having the above six surfaces. It is sufficient that the housing 100 is a polyhedron having six surfaces, and corner portions in which the above six surfaces contact with each other may be rounded.

The array antenna 4A (first array antenna) includes antennas 10G1, 10G2, 10G3, and the patch antennas 10 that are arrayed in a two-dimensional manner. The array antenna 4B (second array antenna) includes antennas 10G4, 10G5, 10G6, and the patch antennas 10 that are arrayed in a two-dimensional manner.

The antenna 10G1 is an example of the antenna 10G in which one patch antenna 10 and one notch antenna 70 are arranged, and is a first antenna element arranged such that a direction from the ground conductor pattern 13 toward the first power feeding conductor pattern 11 coincides with a first direction from the second outer peripheral surface toward the first outer peripheral surface, and a direction from the first power feeding conductor pattern 11 toward the notch antenna 70 coincides with a second direction from the fourth outer peripheral surface toward the third outer peripheral surface.

The antenna 10G2 is an example of the antenna 10G in which one patch antenna 10 and one notch antenna 70 are arranged, and is a second antenna element arranged such that the direction from the ground conductor pattern 13 toward the first power feeding conductor pattern 11 coincides with the first direction, and the direction from the first power feeding conductor pattern 11 toward the notch antenna 70 coincides with a third direction from the sixth outer peripheral surface toward the fifth outer peripheral surface.

The antenna 10G3 is an example of the antenna 10G in which one patch antenna 10 and two notch antennas 70 are arranged, and is an antenna element arranged such that the direction from the ground conductor pattern 13 toward the first power feeding conductor pattern 11 coincides with the first direction, a direction from the first power feeding conductor pattern 11 toward one notch antenna 70 coincides with the second direction, and a direction from the first power feeding conductor pattern 11 toward the other notch antenna 70 coincides with the third direction.

The antenna 10G4 is an example of the antenna 10G in which one patch antenna 10 and one notch antenna 70 are arranged, and is a third antenna element arranged such that the direction from the ground conductor pattern 13 toward the first power feeding conductor pattern 11 coincides with a fourth direction from the first outer peripheral surface toward the second outer peripheral surface, and the direction from the first power feeding conductor pattern 11 toward the notch antenna 70 coincides with a fifth direction from the third outer peripheral surface toward the fourth outer peripheral surface.

The antenna 10G5 is an example of the antenna 10G in which one patch antenna 10 and one notch antenna 70 are arranged, and is a fourth antenna element arranged such that the direction from the ground conductor pattern 13 toward the first power feeding conductor pattern 11 coincides with the fourth direction, and the direction from the first power feeding conductor pattern 11 toward the notch antenna 70 coincides with a six direction from the fifth outer peripheral surface toward the sixth outer peripheral surface.

The antenna 10G6 is an example of the antenna 10G in which one patch antenna 10 and two notch antennas 70 are arranged, and is an antenna element arranged such that the direction from the ground conductor pattern 13 toward the first power feeding conductor pattern 11 coincides with the fourth direction, the direction from the first power feeding conductor pattern 11 toward one notch antenna 70 coincides with the fifth direction, and the direction from the first power feeding conductor pattern 11 to the other notch antenna 70 coincides with the sixth direction.

In FIG. 11B, since the array antenna 4B is arranged on the second outer peripheral surface side which is the back surface of the housing 100 of the mobile terminal 5A, an enlarged view of the array antenna 4B is illustrated as a plan see-through view.

With the above configuration, as illustrated in FIG. 11B, for example, the array antenna 4A is disposed on the upper left surface side of the mobile terminal 5A and the array antenna 4B is disposed on the lower right back surface side of the mobile terminal 5A. At this time, the array antenna 4A arranged on the upper left surface side has directivity in the vertical line upward direction (first direction) of the surface of the mobile terminal and the horizontal line direction (second direction and third direction) of the surface of the mobile terminal. Further, the array antenna 4B arranged on the lower right back surface side has directivity in the vertical line downward direction (fourth direction) of the surface of the mobile terminal and the horizontal line direction (fifth direction and sixth direction) of the surface of the mobile terminal. Thus, it is possible to provide the directivity in all directions of the mobile terminal 5A.

In the above configuration of the mobile terminal 5A, for example, the sizes of the array antennas 4A and 4B are set to 11 mm (widths in the second direction and the fifth direction)×11 mm (widths in the third direction and the sixth direction)×0.87 mm (thicknesses in the first direction and the fourth direction), and the directivity of the gain is examined. Note that the size of the ground substrate on which the array antennas 4A and 4B are arranged is set to 140 mm (width)×70 (width) mm. In this case, in each of the array antenna 4A and the array antenna 4B, peak gain of equal to or higher than 10 dBi is obtained in the first direction or the fourth direction from the four elements of the patch antennas 10. On the other hand, peak gain of 5 dBi is obtained in the second direction, the third direction, the fifth direction, or the sixth direction from two elements of the notch antennas 70 arranged in the same direction (side). Thus, it is possible to configure diversity in which the best is selected from (1) the four elements of the patch antennas 10 (both polarization), (2) a first group of the notch antennas 70 arranged in the same direction (side), and (3) a second group of the notch antennas 70 arranged in the same direction (side), which are arranged perpendicularly to the notch antennas 70 of the first group. When diversity communication using the array antennas 4A and 4B is performed, it is possible to obtain antenna characteristics in which a ratio of equal to or higher than 6 dBi on all spherical surfaces exceeds 80%.

For example, the patch antennas according to the first embodiment and the second embodiment can be applied to a Massive MIMO system. One promising wireless transmission technology of 5G (fifth generation mobile communication system) is a combination of a phantom cell and the Massive MIMO system. The phantom cell is a network configuration that isolates a control signal for ensuring stability of communication between a macrocell of a low frequency band and a small cell of a high frequency band and a data signal that is an object of high-speed data communication. Each phantom cell is provided with a Massive MIMO antenna device. The Massive MIMO system is technology for improving transmission quality in a millimeter wave band or the like, and controls directivity of patch antennas by controlling signals transmitted from the patch antennas. Also, since the Massive MIMO system uses a large number of patch antennas, it is possible to generate beams with sharp directivity. By increasing the directivity of the beams, radio waves can be emitted to a certain extent even in a high frequency band, and interference between the cells can be reduced to enhance the frequency utilization efficiency.

The present disclosure is widely applicable to communication apparatuses for the millimeter wave band mobile communication system, the Massive MIMO system, and the like as the antenna element capable of radiating signals of a plurality of frequency bands with high directivity.

1, 1A ANTENNA MODULE
2 BASE BAND SIGNAL PROCESSING CIRCUIT (BBIC)
3 RF SIGNAL PROCESSING CIRCUIT (RFIC)
4, 4A, 4B ARRAY ANTENNA
5 COMMUNICATION APPARATUS
5A MOBILE TERMINAL
10, 10A, 10B, 10C PATCH ANTENNA
10G, 10G1, 10G2, 10G3, 10G4, 10G5, 10G6 ANTENNA
11, 11A FIRST POWER FEEDING CONDUCTOR PATTERN
12, 12A SECOND POWER FEEDING CONDUCTOR PATTERN
13, 74 GROUND CONDUCTOR PATTERN
14 IMPEDANCE ELEMENT
15 CONDUCTOR VIA
20 DIELECTRIC SUBSTRATE
31A, 31B, 31C, 31D, 33A, 33B, 33C, 33D, 37 SWITCH
32AR, 32BR, 32CR, 32DR LOW NOISE AMPLIFIER
32AT, 32BT, 32CT, 32DT POWER AMPLIFIER
34A, 34B, 34C, 34D ATTENUATOR
35A, 35B, 35C, 35D PHASE SHIFTER
36 SIGNAL MULTIPLEXER/DEMULTIPLEXER
38 MIXER
39 AMPLIFIER CIRCUIT
40 RESIN MEMBER
70 NOTCH ANTENNA
71 POWER FEEDING LINE
72, 73 RADIATION ELECTRODE
75, 76 CAPACITIVE ELEMENT

110 POWER FEEDING CONDUCTOR PATTERN
120 SLIT

The invention claimed is:

1. A communication apparatus comprising:

a first antenna array and a second antenna array having a plurality of antennas, the plurality of antennas including a first antenna, and a third antenna or a fourth antenna, wherein each antenna comprises:

a dielectric substrate;

a planar first power feeding conductor pattern provided on the dielectric substrate and to which a radio frequency (RF) signal for wireless transmission is fed, the RF signal being generated from an RF signal processing circuit;

a planar second power feeding conductor pattern provided on the dielectric substrate and surrounding the first power feeding conductor pattern in a polarization direction when the dielectric substrate is seen in a plan view;

a planar ground conductor pattern provided on the dielectric substrate facing the first power feeding conductor pattern and the second power feeding conductor pattern, the planar ground conductor pattern having a ground potential, wherein the second power feeding conductor pattern does not have the ground potential; and a notch antenna provided on a surface of or inside the dielectric substrate, and at an outer peripheral portion of the second power feeding conductor pattern when the dielectric substrate is seen in the plan view, wherein the notch antenna comprises:

a planar second ground conductor pattern provided on the surface;

a radiation electrode formed on the surface in a region interposed with the second ground conductor pattern; and a capacitive element arranged in the region interposed with the second ground conductor pattern, the capacitive element being connected to the radiation electrode;

the RF signal processing circuit configured to feed the radio frequency signal to the first power feeding conductor pattern; and a housing in which the first antenna array, the second antenna array, and the RF signal processing circuit are arranged, wherein the housing has a hexahedron shape having a first outer peripheral main surface, a second outer peripheral surface opposing the main surface, a third outer peripheral surface perpendicular to the main surface, a fourth outer peripheral surface opposing the third outer peripheral surface, a fifth outer peripheral surface perpendicular to the main surface and to the third outer peripheral surface, and a sixth outer peripheral surface opposing the fifth outer peripheral surface, wherein the first antenna array comprises the first antenna arranged such that a direction from the ground conductor pattern thereof toward the first power feeding conductor pattern thereof corresponds to a first direction from the second outer peripheral surface toward the main surface, and a direction from the first power feeding conductor pattern thereof toward the notch antenna thereof corresponds to a second direction from the fourth outer peripheral surface toward the third outer peripheral surface, and wherein the second antenna array comprises:

the third antenna arranged such that a direction from the ground conductor pattern thereof toward the first power feeding conductor pattern thereof corresponds to a fourth direction from the main surface toward the second outer peripheral surface, and a direction from the first power feeding conductor pattern thereof toward the notch antenna thereof corresponds to a fifth direction from the third outer peripheral surface toward the fourth outer peripheral surface; or the fourth antenna arranged such that a direction from the ground conductor pattern thereof toward the first power feeding conductor pattern thereof corresponds to the fourth direction, and a direction from the first power feeding conductor pattern thereof toward the notch antenna corresponds to a sixth direction from the fifth outer peripheral surface toward the sixth outer peripheral surface.

2. The communication apparatus according to claim 1, wherein the second power feeding conductor pattern is an annular conductor pattern arranged with a predetermined interval from the first power feeding conductor pattern such that the second power feeding conductor pattern surrounds the first power feeding conductor pattern when the dielectric substrate is seen in the plan view.

3. The communication apparatus according to claim 1, wherein each antenna further comprises an impedance element connected between the first power feeding conductor pattern and the second power feeding conductor pattern, wherein a first resonant frequency defined by the first power feeding conductor pattern is greater than a second resonant frequency defined by the first power feeding conductor pattern together with the second power feeding conductor pattern, and wherein an impedance of the impedance element at the second resonant frequency is less than an impedance of the impedance element at the first resonant frequency.

4. The communication apparatus according to claim 2, wherein each antenna further comprises an impedance element connected between the first power feeding conductor pattern and the second power feeding conductor pattern, wherein a first resonant frequency defined by the first power feeding conductor pattern is greater than a second resonant frequency defined by the first power feeding conductor pattern together with the second power feeding conductor pattern, and wherein an impedance of the impedance element at the second resonant frequency is less than an impedance of the impedance element at the first resonant frequency.

5. The communication apparatus according to claim 3, wherein the impedance element is an inductance-capacitance (LC) resonance circuit.

6. The communication apparatus according to claim 3, wherein each antenna further comprises a plurality of impedance elements, and wherein the plurality of impedance elements are symmetrically arranged at positions between the first power feeding conductor pattern and the second power feeding conductor pattern when the dielectric substrate is seen in the plan view.

7. The communication apparatus according to claim 5, wherein each antenna further comprises a plurality of impedance elements, and wherein the plurality of impedance elements are symmetrically arranged at positions between the first power feeding conductor pattern and the second power feeding conductor pattern when the dielectric substrate is seen in the plan view.

8. The communication apparatus according to claim 1, wherein the first antenna array and the second antenna array are one-dimensional or two-dimensional arrays, and wherein the plurality of antennas share a common dielectric substrate and share a common ground conductor pattern.

9. The communication apparatus according to claim 1, wherein:

the first power feeding conductor pattern and the second power feeding conductor pattern are provided on a first main surface of the dielectric substrate, the ground conductor pattern is provided on a second main surface of the dielectric substrate, the second main surface opposing the first main surface, and the RF signal processing circuit is provided on a side of the dielectric substrate corresponding to the second main surface.

10. The communication apparatus according to claim 1, wherein the RF signal processing circuit comprises:

a phase shift circuit configured to shift a phase of the radio frequency signal;

an amplifying circuit configured to amplify the phase-shifted radio frequency signal; and a switch configured to selectively feed the amplified radio frequency signal to the antenna.

11. A communication apparatus comprising:

a first antenna array and a second antenna array having a plurality of antennas, the plurality of antennas including a first antenna, a second antenna, a third antenna, and a fourth antenna, wherein each antenna comprises:

a dielectric substrate;

a planar first power feeding conductor pattern provided on the dielectric substrate and to which a radio frequency signal is fed;

a planar second power feeding conductor pattern provided on the dielectric substrate and surrounding the first power feeding conductor pattern in a polarization direction when the dielectric substrate is seen in a plan view;

a planar ground conductor pattern provided on the dielectric substrate facing the first power feeding conductor pattern and the second power feeding conductor pattern, the planar ground conductor pattern having a ground potential, wherein the second power feeding conductor pattern does not have the ground potential; and a notch antenna provided on a surface of or inside the dielectric substrate, and at an outer peripheral portion of the second power feeding conductor pattern when the dielectric substrate is seen in the plan view, wherein the notch antenna comprises:

a planar second ground conductor pattern provided on the surface;

a radiation electrode formed on the surface in a region interposed with the second ground conductor pattern; and a capacitive element arranged in the region interposed with the second ground conductor pattern, the capacitive element being connected to the radiation electrode;

an RF signal processing circuit configured to feed the radio frequency signal to the first power feeding conductor pattern; and a housing in which the first antenna array, the second antenna array, and the RF signal processing circuit are arranged, wherein the housing has a hexahedron shape having a first outer peripheral main surface, a second outer peripheral surface opposing the main surface, a third outer peripheral surface perpendicular to the main surface, a fourth outer peripheral surface opposing the third outer peripheral surface, a fifth outer peripheral surface perpendicular to the main surface and to the third outer peripheral surface, and a sixth outer peripheral surface opposing the fifth outer peripheral surface, wherein the first antenna array comprises:

the first antenna arranged such that a direction from the ground conductor pattern thereof toward the first power feeding conductor pattern thereof corresponds to a first direction from the second outer peripheral surface toward the main surface, and a direction from the first power feeding conductor pattern thereof toward the notch antenna thereof corresponds to a second direction from the fourth outer peripheral surface toward the third outer peripheral surface; and the second antenna arranged such that a direction from the ground conductor pattern thereof toward the first power feeding conductor pattern thereof corresponds to the first direction, and a direction from the first power feeding conductor pattern thereof toward the notch antenna thereof corresponds to a third direction from the sixth outer peripheral surface toward the fifth outer peripheral surface, and wherein the second antenna array comprises:

the third antenna arranged such that a direction from the ground conductor pattern thereof toward the first power feeding conductor pattern thereof corresponds to a fourth direction from the main surface toward the second outer peripheral surface, and a direction from the first power feeding conductor pattern thereof toward the notch antenna thereof corresponds to a fifth direction from the third outer peripheral surface toward the fourth outer peripheral surface; and the fourth antenna arranged such that a direction from the ground conductor pattern thereof toward the first power feeding conductor pattern thereof corresponds to the fourth direction, and a direction from the first power feeding conductor pattern thereof toward the notch antenna corresponds to a sixth direction from the fifth outer peripheral surface toward the sixth outer peripheral surface.

* * * * *